US008059978B2

(12) United States Patent
Mizushima et al.

(10) Patent No.: US 8,059,978 B2
(45) Date of Patent: Nov. 15, 2011

(54) IMAGE FORMING APPARATUS AND METHOD OF CONTROLLING IMAGE FORMING APPARATUS

(75) Inventors: Nobuyuki Mizushima, Shiojiri (JP); Tomoyuki Shiiya, Matsumoto (JP); Atsushi Imamura, Shiejiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 371 days.

(21) Appl. No.: 12/341,752

(22) Filed: Dec. 22, 2008

(65) Prior Publication Data

US 2009/0175641 A1 Jul. 9, 2009

(30) Foreign Application Priority Data

Dec. 26, 2007 (JP) ..... 2007-333489
Nov. 12, 2008 (JP) ..... 2008-289428

(51) Int. Cl.
*G03G 15/00* (2006.01)

(52) U.S. Cl. ..... 399/45; 399/66

(58) Field of Classification Search ..... 399/45, 399/66, 301, 302, 394
See application file for complete search history.

(56) References Cited

U.S. PATENT DOCUMENTS 6,389,242 B1 * 5/2002 Watanabe ..... 399/45
2007/0110461 A1 * 5/2007 Yoshida ..... 399/44

FOREIGN PATENT DOCUMENTS

JP 2000-275969 10/2000
JP 2006-126258 5/2006

* cited by examiner

*Primary Examiner* — Hoang Ngo
(74) *Attorney, Agent, or Firm* — DLA Piper LLP (US)

(57) ABSTRACT

An image forming apparatus comprising: an image carrier that carries an image; a charging section that electrically charges the image carrier; an exposure section that forms a latent image on the image carrier electrically charged by the charging section; a development section that develops the latent image formed by the exposure section on the image carrier by means of a liquid developer; a primary transfer section that transfers a image developed by the development section onto a transfer medium; a secondary transfer section that transfers a image transferred onto the transfer medium further onto a recording medium by pressing the transfer medium; and a variable transfer pressure application section that applies transfer pressure of a first level or of a second level at the secondary transfer section.

7 Claims, 14 Drawing Sheets

IMAGE FORMING APPARATUS AND METHOD OF CONTROLLING IMAGE FORMING APPARATUS

CROSS REFERENCE TO RELATED APPLICATIONS

This application is based upon and claims the benefit of priority from prior Japanese Patent Application No. 2007-333489, filed Dec. 26, 2007 and Japanese patent Application No. 2008-289428, filed Nov. 12, 2008, the entire contents of which are incorporated herein by reference.

BACKGROUND

1. Technical Field

The present invention relates to an image forming apparatus for forming a color image by superposing liquid developers of a plurality of different colors and a method of controlling an image forming apparatus. More particularly, the present invention relates to an image forming apparatus for forming a color image on a transfer medium by repeatedly executing a transfer step of transferring a developed image formed on an image carrier onto an intermediate transfer medium such as an intermediate transfer belt for a plurality of liquid developers.

2. Description of the Related Art

Various wet-developing image forming devices for developing a latent image by means of a high viscosity liquid developer prepared by dispersing solid toner into a liquid solvent to visualize an electrostatic latent image have been proposed. A developer to be used for such wet-developing image forming devices is prepared by suspending the solid component (toner particles) in an organic solvent (carrier liquid) of silicon oil, mineral oil, edible oil or the like that is electrically insulating and highly viscous. Toner particles are very fine and have a particle size of about 1 μm. Thus, wet-developing image forming devices can form high quality images if compared with dry-developing image forming devices designed to use powdery toner particles having a particle size of about 7 μm mainly because of such fine toner particles they employ.

While wet-developing image forming devices can produce high quality images because of fine toner particles they employ, it is known that their transfer efficiency shows temperature dependence so that it is believed that wet-developing image forming devices are less stable in terms of image forming performance if compared with dry-developing image forming devices. It is also known that optimum transfer conditions of a wet-developing image forming devices differ from recording medium to recording medium (coat paper, plain paper, etc.) onto which a toner image is transferred. The above-identified problems of wet-developing image forming devices designed to use liquid developers are described, for example, in JP-A-2000-275969. The patent document describes that those problems can be overcome by controlling the temperature of the transfer process.

SUMMARY

JP-A-2000-275969 discloses an invention of efficiently transferring a toner image on any of various recording mediums of different types by controlling the temperature of the transfer process. However, it is highly difficult to rigorously control the temperature to realize optimum transfer conditions.

According to the present invention, the above problem is dissolved by providing an image forming apparatus including: an image carrier for carrying an image; a charging section for electrically charging the image carrier; an exposure section for forming a latent image on the image carrier electrically charged by the charging section; a development section for developing the latent image formed by the exposure section on the image carrier by means of a liquid developer; a primary transfer section for transferring the image developed by the development section onto a transfer medium; a secondary transfer section for transferring the image transferred onto the transfer medium further onto a recording medium by pressing the transfer medium; and a variable transfer pressure application mechanism for applying transfer pressure of a first level or of a second level at the secondary transfer section.

Preferably, the image forming apparatus according to the present invention as defined above further includes: a paper type memory section for storing a type of recording medium to be transferred by the secondary transfer section; and a variable transfer pressure application mechanism control section for controlling the variable transfer pressure application mechanism to apply transfer pressure of the first level or of the second level according to the type of recording medium stored in the paper type memory section.

Preferably, in the image forming apparatus according to the present invention as defined above, the secondary transfer section has a first roller for pressing the transfer medium and a second roller for pressing the transfer medium; and the first roller of the variable transfer pressure application mechanism applies transfer pressure of the first level or of the second level to the transfer medium.

Preferably, in the image forming apparatus according to the present invention as defined above, the first roller is separated from the transfer medium by the variable transfer pressure application mechanism.

In another aspect of the present invention, there is provided an image forming apparatus including: a first image carrier for carrying an image; a first charging section for electrically charging the first image carrier; a first exposure section for forming a latent image on the first image carrier electrically charged by the first charging section; a first development section for developing the latent image formed by the first exposure section on the first image carrier by means of a first liquid developer; a first primary transfer section for transferring the first image developed by the first development section onto a transfer medium; a second image carrier for carrying an image; a second charging section for electrically charging the second image carrier; a second exposure section for forming a latent image on the second image carrier electrically charged by the second charging section; a second development section for developing the latent image formed by the second exposure section on the second image carrier by means of a second liquid developer; a second primary transfer section for transferring the second image developed by the second development section onto the transfer medium; a secondary transfer section for transferring the first image and the second image transferred onto the transfer medium further onto a recording medium; and a variable transfer pressure application mechanism for applying transfer pressure of a first level or of a second level at the secondary transfer section.

Preferably, the image forming apparatus according to the present invention as defined above further includes: a paper type memory section for storing a type of recording medium to be transferred by the secondary transfer section; and a variable transfer pressure application mechanism control section for controlling the variable transfer pressure application mechanism to apply transfer pressure of the first level or of the second level according to the type of recording medium stored in the paper type memory section.

Preferably, the image forming apparatus according to the present invention as defined above further includes: an optical sensor for detecting the first image and the second image transferred onto the transfer medium; a computing section for calculating the distance between the first image and the second image according to the detection by the optical sensor; and a timing modification control section for modifying the timing of light emission of the first exposure section according to the distance calculated by the computing section.

Preferably, in the image forming apparatus according to the present invention as defined above, the timing modification control section modifies the timing of light emission of the second exposure section.

Preferably, the image forming apparatus according to the present invention as defined above further includes: a recording medium information input section for inputting the type of recording medium; the timing modification control section being driven to operate in response to the input of information on the recording medium to the recording medium information input section.

Preferably, the image forming apparatus according to the present invention as defined above further includes: a data input section for inputting image data: the timing modification control section being driven to operate in response to the input of the image data to the data input section.

In still another aspect of the present invention, there is provided a method of controlling an image forming apparatus, the method including: electrically charging a first image carrier by a first charging section; exposing the first image carrier electrically charged by the first charging section to light by a first exposure section; developing the latent image formed by the first exposure section on the first image carrier by a first development section by means of a first liquid developer; transferring the first image developed by the first development section onto a transfer medium by a first primary transfer section; electrically charging a second image carrier by a second charging section; exposing the second image carrier electrically charged by the second charging section to light by a second exposure section; developing the latent image formed by the second exposure section on the second image carrier by a second development section by means of a second liquid developer; transferring the second image developed by the second development section onto a transfer medium by a second primary transfer section; and transferring the first image and the second image transferred onto the transfer medium further onto a recording medium, applying transfer pressure of a first level or of a second level at the secondary transfer section.

Preferably, the method of controlling an image forming apparatus according to the present invention as defined above further includes: storing a type of recording medium to be transferred by the secondary transfer section in a paper type memory section; and transferring the images at the secondary transfer section, applying transfer pressure of a first level or of a second level according to the type of recording medium stored in the paper type memory section.

Preferably, the method of controlling an image forming apparatus according to the present invention as defined above further includes: detecting the first image and the second image transferred onto the transfer medium by an optical sensor; calculating the distance between the first image and the second image by a computing section according to the detection by the optical sensor; and modifying the timing of light emission of the first exposure section according to the distance calculated by the computing section.

Preferably, the method of controlling an image forming apparatus according to the present invention as defined above further includes: modifying the timing of light emission of the second exposure section according to the distance calculated by the computing section.

Preferably, the method of controlling an image forming apparatus according to the present invention as defined above further includes: modifying the timing of light emission of the first exposure section in response to a shift of the type of recording medium to be transferred at the secondary transfer section.

Thus, according to the present invention, a paper type memory means is provided to store the type of recording medium for carrying the image to be transferred by the secondary transfer means and the transfer pressure of the variable transfer pressure application mechanism is modified according to the type of recording medium stored in the paper type memory means so that the transfer process can be executed optimally according to the type of recording medium.

Additionally, according to the present invention, any color shift that may arise when the transfer pressure of the variable transfer pressure application mechanism is changed is corrected in a color shift correction mode so that the present invention can prevent color shift from taking place.

Note that an embodiment defined below as reference is also within the scope of the present invention. A reference embodiment of image forming apparatus according to the present invention includes: a plurality of image carriers for carrying respective developed images of different colors developed from respective latent images by respective developers of the different colors containing a carrier and toner particles; an intermediate transfer body for carrying the developed images transferred from the plurality of image carriers while moving in a predetermined direction; a secondary transfer means for transferring the developed single image on the intermediate transfer body onto a recording medium; a variable transfer pressure application mechanism for varying transfer pressure at the secondary transfer means; and a paper type memory means for storing the type of recording medium for carrying the image to be transferred by the secondary transfer means, and the transfer pressure of the variable transfer pressure application mechanism being modified according to the type of recording medium stored in the paper type memory means.

Preferably, in the reference embodiment of image forming apparatus according to the present invention, the secondary transfer means includes a upstream section roller pair and a downstream section roller pair and the variable transfer pressure application mechanism is arranged at the upstream section roller pair.

Preferably, the reference embodiment of image forming apparatus according to the present invention further includes: an optical sensor for detecting the developed image transferred to a predetermined position on the intermediate transfer body; the image forming apparatus being adapted to operate in a color shift correction mode where the plurality of image carriers transfer respective registration marks to a predetermined position on the intermediate transfer body and the optical sensor detects the registration marks for the image forming apparatus to calculate the amounts of the color shifts of different colors and correct the calculated amounts of the color shifts.

Preferably, in the reference embodiment of image forming apparatus according to the present invention, the operation of correcting the amounts of the color shifts in a color shift correction mode is triggered by the timing of forming a latent image.

Preferably, in the reference embodiment of image forming apparatus according to the present invention, the operation of correcting the amounts of the color shifts in a color shift correction mode is triggered by a moving speed of the intermediate transfer body.

Preferably, in the reference embodiment of image forming apparatus according to the present invention, the operation of correcting the amounts of the color shifts in a color shift correction mode is triggered by the start of operation of the apparatus.

Preferably, in the reference embodiment of image forming apparatus according to the present invention, the operation of correcting the amounts of the color shifts in a color shift correction mode is triggered by a shift of the type of recording medium stored in the paper type memory means.

A reference embodiment of method of controlling an image forming apparatus according to the present invention, the apparatus including: a plurality of image carriers for carrying respective developed images of different colors developed from respective latent images by respective developers of the different colors containing a liquid carrier and toner particles; an intermediate transfer body for carrying the developed images transferred from the plurality of image carriers as a single image while moving in a predetermined direction; a secondary transfer means for transferring the developed single image on the intermediate transfer body onto a recording medium; a paper type memory means for storing the type of recording medium for carrying the image to be transferred by the secondary transfer means; and an optical sensor for detecting the developed image transferred to a predetermined position on the intermediate transfer body; the method includes a color shift correction mode where the plurality of image carriers transfer respective registration marks to a predetermined position on the intermediate transfer body and the optical sensor detects the registration marks to calculate the amounts of the color shifts of different colors and correct the calculated amounts of the color shifts, and the method including: modifying setting of the transfer pressure of the variable transfer pressure application mechanism according to the type of recording medium stored in the paper type memory means; and operating the color shift correction mode when modifying the setting.

Thus, according to the present invention, a paper type memory means for storing the type of recording medium to be transferred by the secondary transfer means is arranged and the transfer pressure of the variable transfer pressure application mechanism is modified according to the type of recording medium stored in the paper type memory means so that a transfer operation can be performed optimally according to the type of recording medium.

Additionally, according to the present invention, an operation of correcting the amounts of the color shifts in a color shift correction mode is triggered when the transfer pressure of the variable transfer pressure application mechanism is modified so that any color shift can be prevented from taking place.

DETAILED DESCRIPTION OF THE PREFERRED EMBODIMENTS

Figure 1:
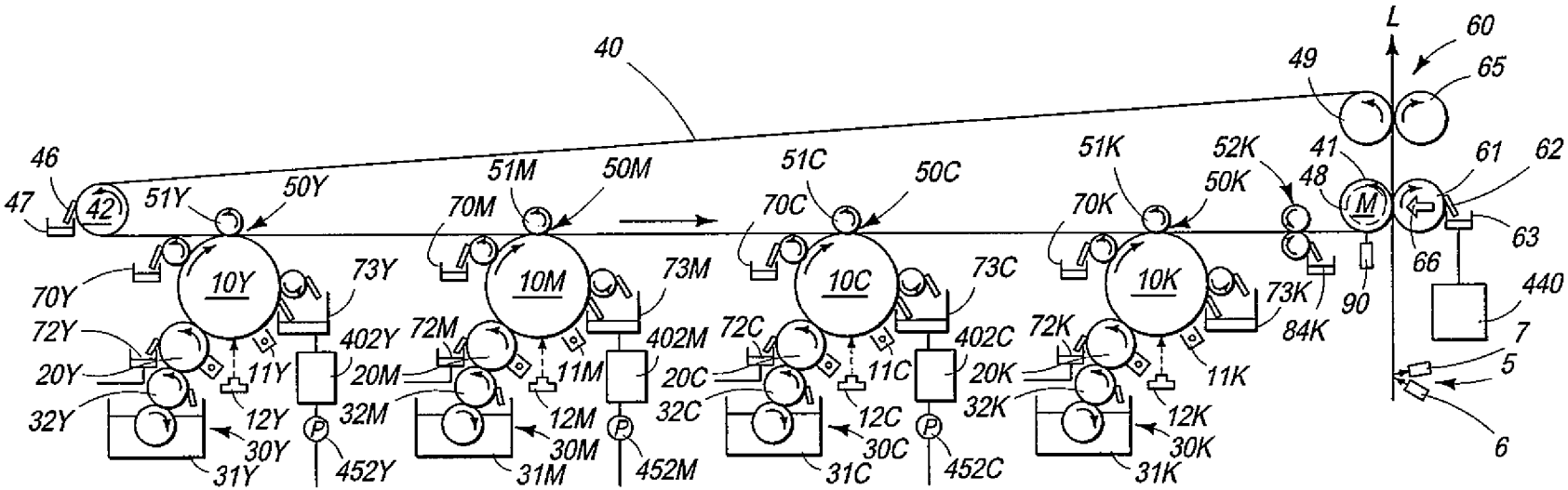
FIG. 1 is a schematic illustration of an image forming apparatus according to an embodiment of the present invention, showing principal components thereof.

Now, preferred embodiments of the present invention will be described in greater detail by referring to the accompanying drawings. FIG. 1 is a schematic illustration of an image forming apparatus according to an embodiment of the present intention, showing principal components thereof. Image forming sections of different colors are arranged in a central part of the image forming apparatus and development devices 30Y, 30M, 30C and 30K are arranged in a lower part of the image forming apparatus, while an intermediate transfer body 40 and a secondary transfer section (secondary transfer unit) 60 are arranged in an upper part of the image forming apparatus.

The image forming sections include image carriers 10Y, 10M, 10C and 10K, corona chargers 11Y, 11M, 11C and 11K and exposure units 12Y, 12M, 12C and 12K (not shown). The exposure units 12Y, 12M, 12C and 12K have respective optical systems that include semiconductor lasers, polygon mirrors and F-θ lenses. The image carriers 10Y, 10M, 10C and 10K are respectively adapted to be electrically uniformly charged by the corona chargers 11Y, 11M, 11C and 11K and irradiated with laser beams, which are modulated by the input image signals, by the exposure units 12Y, 12M, 12C and 12K to form electrostatic latent images on the electrically charged image carriers 10Y, 10M, 10C and 10K.

The development devices 30Y, 30M, 30C and 30K respectively include development rollers 20Y, 20M, 20C and 20K, developer reservoirs 31Y, 31M, 31C and 31K storing liquid developers of yellow (Y), magenta (M), cyan (C) and black (K) and anilox rollers 32Y, 32M, 32C and 32K that are application rollers for applying developers of the respective colors from the developer reservoirs 31Y, 31M, 31C and 31K to the development rollers 20Y, 20M, 20C and 20K. Thus, the electrostatic latent images formed on the respective image carriers 10Y, 10M, 10C and 10K are developed by liquid developers of the respective colors.

The intermediate transfer body 40 is an endless belt wound around a drive roller 41, a follower roller 49 and a tension roller 42 and adapted to be driven by the drive roller 41, which is by turn driven to rotate by a motor 48, to move around while being held in contact with the image carriers 10Y, 10M, 10C and 10K of the primary transfer sections 50Y, 50M, 50C and 50K.

The primary transfer sections 50Y, 50M, 50C and 50K have respective primary transfer rollers 51Y, 51M, 51C and 51K that are arranged respectively opposite to the image carriers 10Y, 10M, 10C and 10K with the intermediate transfer body 40 interposed between them. Thus, the developed toner images of the respective colors on the image carriers 10Y, 10M, 10C and 10K are sequentially transferred onto the intermediate transfer body 40 so as to be laid one on the other at the respective transfer positions that are the contact positions of the image carriers 10Y, 10M, 10C and 10K and the intermediate transfer body 40.

The secondary transfer unit 60 includes an upstream secondary transfer roller 61 arranged opposite to the belt drive roller 41 with the intermediate transfer body 40 interposed between them and a downstream secondary transfer roller 65 arranged opposite to the belt follower roller 49 also with the intermediate transfer body 40 interposed between them. The upstream secondary transfer roller 61 is provided with a variable transfer pressure application mechanism 66 for adjusting the pressure being applied to the belt drive roller 41 by the upstream secondary transfer roller 61. The upstream secondary transfer roller 61 is also provided with a cleaning device, or a secondary transfer roller cleaning blade 62.

The toner image formed on the intermediate transfer body 40, which may be a monochromatic image or a full color image, is transferred onto a recording medium, which may typically be a sheet of paper, film or cloth, being conveyed along a sheet material conveyance route L between the nip portion formed by the upstream secondary transfer roller 61 and the intermediate transfer body 40 and the nip portion formed by the downstream secondary transfer roller 65 and the intermediate transfer body 40.

The upstream secondary transfer roller 61 and the downstream secondary transfer roller 65 press the recording medium respectively against the intermediate transfer body 40 wound around the belt drive roller 41 and the belt follower roller 49 and transfers, in a secondary transfer operation, the color toner image (liquid developer image) formed by combining the toner images of the respective colors on the intermediate transfer body 40 onto the recording medium, which may typically be a sheet of paper, while transferring the sheet of paper that is carried by and tightly held in contact with the intermediate transfer body 40. The pressure that the downstream secondary transfer roller 65 applies is set to a constant level of 1.0 N/cm$^2$. With this arrangement, the full color toner image on the intermediate transfer body 40 is transferred on the recording medium that is tightly held in contact with the intermediate transfer body 40 during a predetermined time period to satisfactorily complete the secondary transfer operation.

The pressure applied to the recording medium can be changed only by the upstream secondary transfer roller 61 of the secondary transfer unit 60, while the pressure that the downstream secondary transfer roller 65 applies is set to a constant level of 1.0 N/cm$^2$. The objective of this arrangement is, that the upstream secondary transfer roller 61 takes the role of securely transferring the full color toner image onto the recording medium and the downstream secondary transfer roller 65 takes the role of providing an improved effect of peeling off the sheet of paper. Thus, the arrangement necessary for changing the pressure is made simple to allow the apparatus to be downsized.

A fixation unit is arranged at a downstream of the sheet material conveyance route L to melt the toner of the monochromatic toner image or the full color toner image transferred onto the recording medium, or the sheet of paper, so as to fix the toner image and make it firmly adhere to the sheet of paper.

The tension roller 42 holds the intermediate transfer body 40 under tension along with the belt drive roller 41 and the follower roller 49. A cleaning device that is an intermediate transfer body cleaning blade 46 is arranged and held in contact with the intermediate transfer body 40 at the position where it is wound around the tension roller 42.

Figure 2:
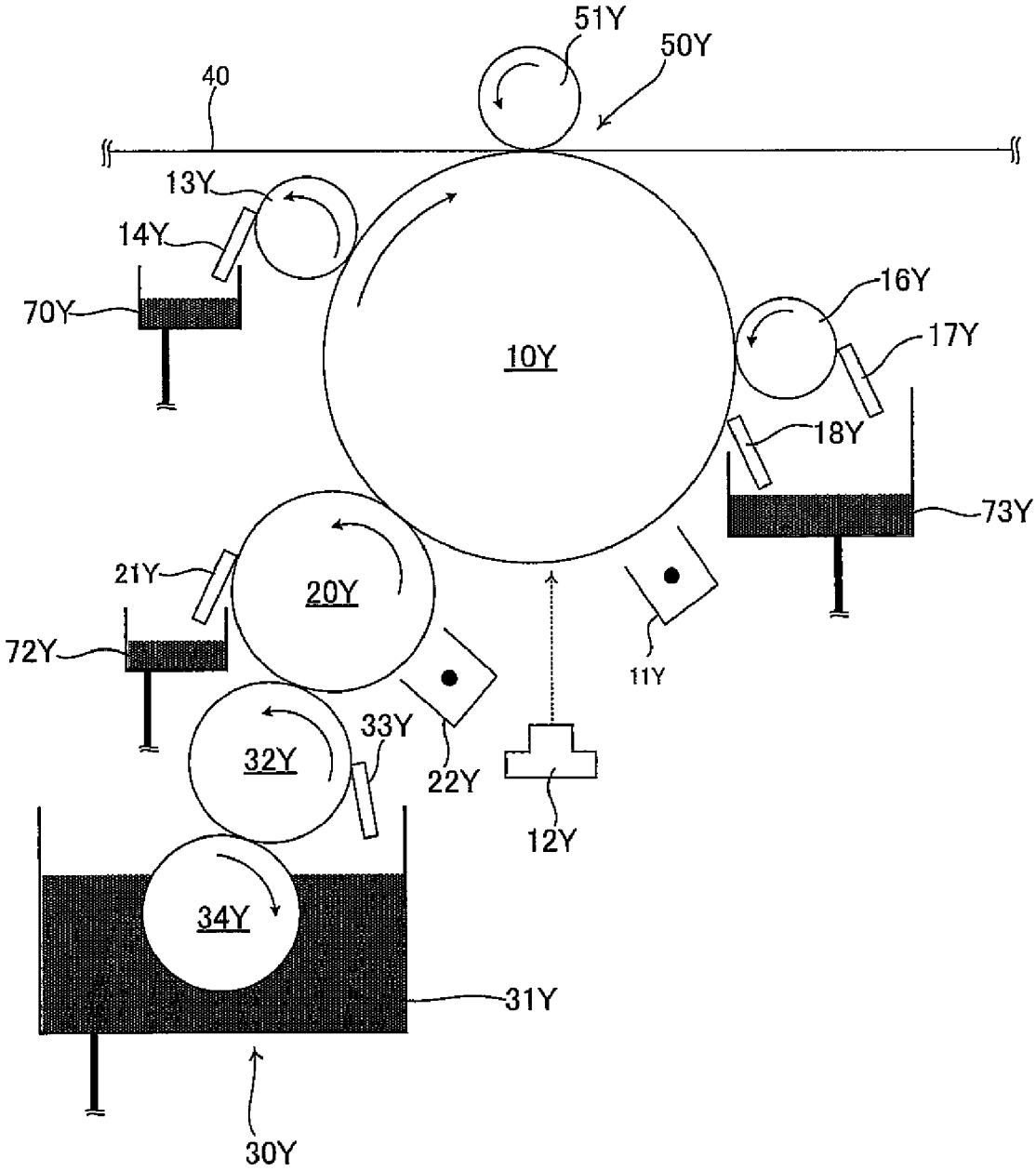
FIG. 2 is a schematic cross-sectional view of one of the image forming sections and the corresponding development device according to the embodiment of the present invention, showing principal components thereof.

Now, the image forming sections and the development devices of the image forming apparatus according to this embodiment of the present invention will be described below. FIG. 2 is a schematic cross-sectional view of one of the image forming sections and the corresponding development devices showing principal components thereof. Since all the image forming sections and all the development devices are the same and identical in terms of configuration, only the yellow (Y) image forming section and the yellow development device are shown in FIG. 2 and will be described below.

An image carrier cleaning roller 16Y, an image carrier cleaning blade 18Y, a corona charger 11Y, an exposure unit 12, a development roller 20Y of the development device 30Y and an image carrier squeezing roller 13Y are arranged in the image forming section along the outer periphery of the image carrier 10Y in the mentioned order in the sense of rotation of the image carrier 10Y.

In FIG. 2, 17Y denotes an image carrier cleaning roller cleaning blade for cleaning the image carrier cleaning roller 16Y. The image carrier squeezing roller 13Y is provided with a cleaning device that is an image carrier squeezing roller cleaning blade 14Y as an accessory element.

In FIG. 2, 70Y denotes a first image carrier developer collecting section for receiving the liquid developer dropping from the image carrier squeezing roller cleaning blade 14Y and 73Y denotes a third image carrier developer collecting section for receiving the liquid developer dropping from the image carrier cleaning roller cleaning blade 17 and the image carrier cleaning blade 18Y. A pipe for flowing the liquid developer received from the blade 14Y is connected to the bottom of the first image carrier developer collecting section 70, while another pipe for flowing the liquid developer received from the blades 14Y and 73Y is connected to the bottom of the third image carrier developer collecting section 73.

A development roller cleaning blade 21Y, an anilox roller 32Y and a toner compactor/corona generator 22Y are arranged along the outer periphery of the development roller 20Y of the development device 30Y. A limiter blade 33Y for adjusting the rate at which liquid developer is supplied to the development roller 20Y is held in contact with the anilox roller 32Y.

In FIG. 2, 72Y denotes a development roller developer collecting section for receiving the liquid developer dropping from the development roller cleaning blade 21. A pipe for flowing the liquid developer received from the blade 21Y is connected to the bottom of the development roller developer collecting section 72Y. A liquid developer supply roller 34Y is contained in the liquid developer container 31Y.

A primary transfer roller 51Y is arranged along the intermediate transfer body 40 at a position opposite to the image carrier 10Y.

Figure 3:
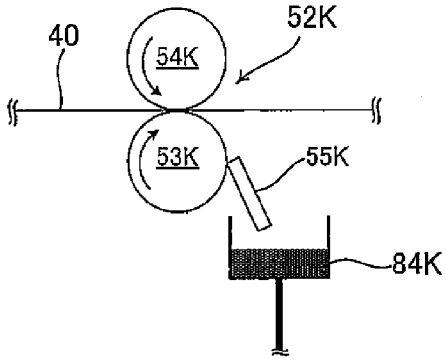
FIG. 3 is a schematic illustration of the intermediate transfer body squeezing device of the image forming apparatus according to the embodiment of the present invention.

FIG. 3 is a schematic illustration of the intermediate transfer body squeezing device of the image forming apparatus according to the embodiment of the present invention. The intermediate transfer body squeezing device is for squeezing the intermediate transfer body 40 arranged immediately downstream relative to the primary transfer nip portion of the image bearing 10K. In this embodiment, an intermediate transfer body squeezing device 52K that includes an intermediate transfer body squeezing roller 53K, a backup roller 54K and an intermediate transfer body squeezing roller cleaning blade 55K is arranged at the downstream side of the development device 30K in the sense of the moving direction of the intermediate transfer body 40.

In FIG. 3, 84K denotes a first intermediate transfer body developer collecting section for receiving the liquid developer dropping from the intermediate transfer body squeezing roller cleaning blade 55K. A pipe for flowing the liquid developer received from the blade 55K is connected to the bottom of the first intermediate transfer body developer collecting section 84K.

The image carrier 10Y is a photosensitive drum broader than the development roller 20Y. It is a cylindrical member having a photosensitive layer formed on the outer peripheral surface thereof and adapted to rotate clockwise in FIG. 2. The photosensitive layer of the image carrier 10Y is typically made of an organic material or amorphous silicon. The corona charger 11Y is arranged upstream relative to the nip portion of the image carrier 10Y and the development roller 20Y in the sense of rotation of the image carrier 10Y and a voltage is applied to it from a power supply unit (not shown) to corona-charge the image carrier 10Y. The exposure unit 12Y irradiates a laser beam onto the corona-charged image carrier 10Y at a position downstream relative to the corona charger 11Y in the sense of rotation of the image carrier 10Y to form a latent image on the image carrier 10Y.

There are rollers and other members arranged upstream relative to other rollers and other members arranged downstream throughout the image forming process and such rollers and other members will be referred to as upstream rollers and upstream members hereinafter.

The development device 30Y includes a toner compactor/corona generator 22Y that operates to compact toner and a developer container 31Y for storing liquid developer where toner is dispersed in a carrier at a weight ratio of about 20%.

The development device 30Y includes a development roller 20Y for carrying liquid developer as described above, an anilox roller 32Y which is an application roller for applying liquid developer onto the development roller 20Y, a limiter blade 33Y for limiting the amount of liquid developer applied to the development roller 20Y, a supply roller 34Y for conveying and supplying liquid developer to the anilox roller 32Y, while agitating it, a toner compactor/corona generator 22Y for compacting the liquid developer being carried by the development roller 20Y and a development roller cleaning blade 21Y for cleaning the development roller 20Y.

The liquid developer contained in the developer container 31Y is non-volatile liquid developer that is a high concentration and high viscosity liquid developer not volatile at room temperature unlike popular volatile liquid developers that are low concentration (about 1 to 2 wt %) and low viscosity liquid developers volatile at room temperature prepared by using Isopar (trademark, available from Exxon) as carrier. In other words, a liquid developer to be used for the purpose of the present invention is a high viscosity (about 30 to 10,000 mPa·s) liquid developer prepared by adding solid particles of an average particle size of 1 μm, which is formed by dispersing a coloring agent such as a pigment in a thermoplastic resin material, into a liquid solvent such as an organic solvent, silicon oil, mineral oil or edible oil with a dispersant to make it show a solid concentration of about 20%.

The anilox roller 32Y operates as application roller for supplying and applying liquid developer to the development roller 20Y. The anilox roller 32Y is a cylindrical member having fine and uniform spiral grooves formed on the surface thereof so as to be able to carry developer with ease. Thus, liquid developer is supplied from the developer container 31Y to the development roller 20Y by way of the anilox roller 32Y. When the image forming apparatus is in operation, the supply roller 34Y rotates clockwise to supply liquid developer to the anilox roller 32Y and the anilox roller 32Y rotates counterclockwise to apply liquid developer to the development roller 20Y as shown in FIG. 2.

The limiter blade 33Y is an elastic blade having an elastic coat layer formed on the surface thereof. It includes a rubber section typically made of urethane rubber and held in contact with the surface of the anilox roller 32Y and a plate typically made of metal and supporting the rubber section. Thus, it limits the film thickness and amount of liquid developer carried and conveyed by the anilox roller 32Y and adjusts the amount of liquid developer supplied to the development roller 20Y.

The development roller 20Y is a cylindrical member that is driven to rotate counterclockwise as shown in FIG. 2 around the axis of rotation thereof. The development roller 20Y is formed by arranging an elastic layer of polyurethane, silicon robber or NBR around the outer periphery of an inner core that is made of metal such as iron. The development roller cleaning blade 21Y is made of rubber and held in contact with the surface of the development roller 20Y. It is arranged downstream relative to the development nip portion where the development roller 20Y and the image carrier 10Y contact with each other in the sense of rotation of the development roller 20Y and adapted to scrape off and remove the liquid developer remaining on the development roller 20Y.

The toner compactor/corona generator 22Y is an electric field application means for boosting the charge of bias on the surface of the development roller 20Y. An electric field is applied to the liquid developer that is being conveyed by the development roller 20Y at a toner compaction site by the toner compactor/corona generator 22Y that applies the electric field toward the development roller 20Y as shown in FIG. 2.

A compaction roller may be used for the electric field application means for compacting toner instead of the corona discharger for corona discharge as shown in FIG. 2. Such a compaction roller is typically an elastic roller, or a cylindrical member, formed by arranging an elastic coat layer on the surface of a metal roller base member as a conductive resin or rubber layer just like the development roller 20Y. It is driven to rotate clockwise, or in the sense of rotation opposite to that of the development roller 20Y as shown in FIG. 2.

On the other hand, the developer containing compacted toner and carried by the development roller 20Y operates to develop the latent image on the image carrier 10Y at the development nip portion where the development roller 20Y contacts the image carrier 10Y as a desired electric field is applied thereto. The residual developer that is not consumed for developing the latent image is scraped off and removed by the development roller cleaning blade 21Y so as to be dropped into the development roller developer collecting section 72Y for reuse. The carrier and the toner that are reused in this way are not in a mixed color state.

The image carrier squeezing device is arranged opposite to the image carrier 10Y, or at a position upstream relative to the primary transfer site and downstream relative to the development roller 20Y in order to collect the excessive developer that is not consumed for developing the toner image on the image carrier 10Y. It includes an image carrier squeezing roller 13Y that is an elastic roller member having an elastic surface coat layer and held in contact with the image carrier 10Y so as to be driven to rotate by the latter and an image carrier squeezing roller cleaning blade 14Y pressed against the image carrier squeezing roller 13Y to slide on and clean the surface of the latter. It operates to collect the excessive carrier and the unnecessary foggy toner of the developer left on the image carrier 10Y after the latent image on the image carrier 10Y is developed in order to raise the content ratio of toner particles in the visible image.

In the primary transfer section 50Y, the developer image, or the developed latent image, on the image carrier 10Y is transferred onto the intermediate transfer body 40 by the primary transfer roller 51Y. The image carrier 10Y and the intermediate transfer body 40 are driven to rotate at the same surface speed in order to reduce the drive load for driving them to rotate and move and suppress the influence of external turbulence, if any, to the visible toner image on the image carrier 10Y.

The cleaning device that is arranged opposite to the image carrier 10Y is located downstream relative to the primary transfer section 50Y so as to collect the excessive liquid developer on the surface of the image carrier 10Y before a new electrostatic latent image is formed thereon. As shown in FIG. 2, the cleaning device includes an image carrier cleaning roller 16Y that is an elastic roller member having an elastic surface coat layer and held in contact with the image carrier 10Y so as to be driven to rotate by the latter and an image carrier cleaning roller cleaning blade 17 pressed against the image carrier cleaning roller 16Y to clean the surface of the cleaning roller 16Y. The cleaning device operates to collect the excessive carrier and the unnecessary toner that is not transferred. The image carrier cleaning roller 16Y is formed by arranging a rubber layer on the surface of a metal roller base member and a bias voltage is applied to it in order to draw toner particles from the image carrier 10Y. The image carrier cleaning roller 16Y is arranged mainly for the purpose of cleaning the toner particle component in the remaining liquid developer.

An image carrier cleaning blade 18Y is arranged downstream relative to the image carrier cleaning roller 16Y in order to completely clean the surface of the image carrier 10Y before a new latent image is formed on the latter. The image comparator cleaning blade 18Y is arranged mainly in order to completely clean the carrier component of the liquid developer remaining on the surf ace of the image carrier 10Y.

The intermediate, transfer body squeezing device 52K is arranged downstream relative to the primary transfer section 50K in order to remove the excessive carrier liquid from the intermediate transfer body 40 and raise the content ratio of toner particles in the visible image.

Like the image carrier squeezing device, the intermediate transfer body squeezing device 52K includes an intermediate transfer body squeezing roller 53Y that is an elastic roller member having an elastic surface coat layer and held in contact with the intermediate transfer body 40 so as to be driven to rotate by the latter, a backup roller 54K arranged opposite to the intermediate transfer body squeezing roller 53K with the intermediate transfer body 40 interposed between them and a cleaning blade 55K pressed against the intermediate transfer body squeezing roller 53K to slide on and clean the surface thereof. It operates to collect the excessive carrier and the unnecessary foggy toner of the developer transferred onto the intermediate transfer body 40 for a primary transfer.

Now, the mechanism for optimally transferring an image onto a recording medium according to the type of recording medium will be described below. The image forming apparatus of this embodiment can print an image on a recording medium, or a sheet of paper, of any of various different types (coat paper such as art paper, non-coat paper such as high-quality paper and plain paper, etc.) by executing a transfer process in optimum transfer conditions that may vary depending on the paper type of recording medium. The optimum transfer condition depends on the type of recording medium, this is because the carrier amount required in the secondary transfer process differs depending on the paper type.

The transfer process can be executed under relatively low pressure on a recording medium having a relatively smooth surface with few microscopic undulations such as coat paper, whereas it needs to be executed under relatively high pressure on a recording medium having relatively a coarse surface with many microscopic undulations such as high-quality paper or plain paper. Table 1 below shows pressure values of the upstream secondary transfer roller 61 defined corresponding to paper types. Either of the transfer pressure values of the upstream secondary transfer roller 61 can be selected by changing, if necessary, the set roller pressure value of the variable transfer pressure application mechanism 66. As shown in Table 1, a roller pressure value of 1.7 N/cm$^2$ is set as the transfer pressure of the upstream secondary transfer roller 61 for a sheet of coat paper, whereas a roller pressure value of 20.0 N/cm$^2$ is set as the transfer pressure of the upstream secondary transfer roller 61 for a sheet of non-coat paper.

TABLE 1

| | coat paper | non-coat paper |
|---|---|---|
| upstream secondary transfer roller pressure [N/cm$^2$] | 1.7 | 20.0 |

A relatively low roller pressure value may be defined in the secondary transfer unit for sheets of coat paper if compared with the roller pressure value defined for sheets of non-coat paper because sheets of coat paper have less surface undulations and an image can be transferred thereto more satisfactorily if compared with sheets of non-coat paper. Conversely, carrier in liquid toner can penetrate more easily into a sheet of coat paper than into a sheet of non-coat paper and possibly down to the rear surface of the sheet to give rise to a problem of back smearing. Therefore, an excellent image can be produced without any back smearing, while securing a good transfer performance, by selecting a low pressure level for the upstream secondary transfer roller 61.

In this embodiment, a paper type determining sensor 5 is arrange to detect the type of recording medium as shown in FIG. 1. The paper type determining sensor 5 includes a light-emitting element 6 for irradiating light onto the recording medium being conveyed along the conveyance route and a light-receiving element 7 for detecting the reflectance of reflected light from the recording medium. In this embodiment, a signal representing typically the reflectance of reflected light that is generated by the light-receiving element 7 is input to a control section formed by a CPU or the like (not shown) so that the paper type (coat paper, non-coat paper, etc.) of recording medium is determined there. Information on the paper type determined by the paper type determining sensor 5 is stored in the paper type memory section in the control section.

Figure 4:
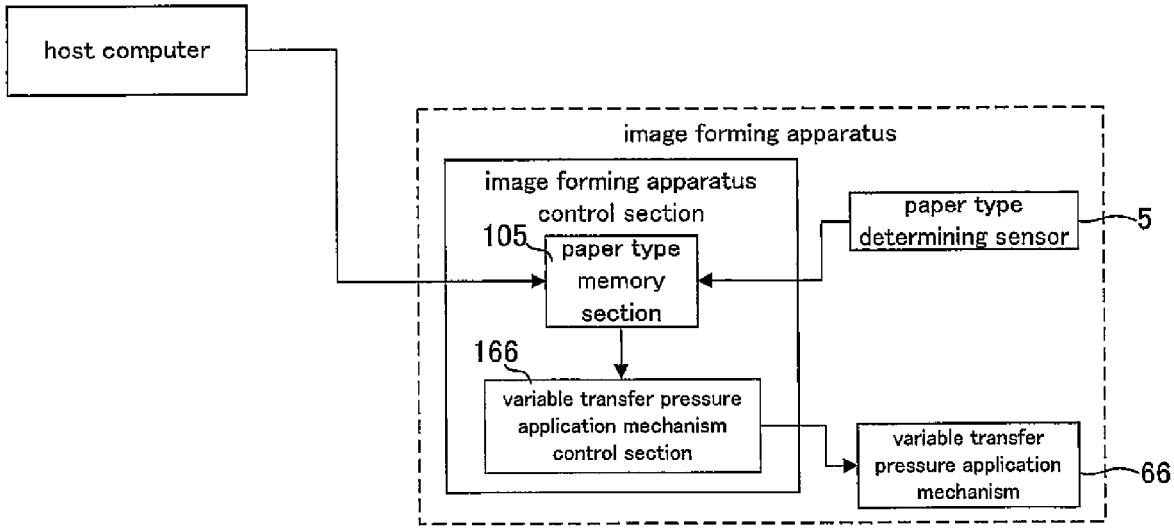
FIG. 4 is a schematic block diagram of the paper type memory section and some of the related components thereof of the image forming apparatus according to the embodiment of the present invention.

FIG. 4 is a schematic block diagram of the paper type memory section and some of the related components thereof of the image forming apparatus of this embodiment of the invention. In FIG. 4, the block surrounded by dotted lines indicates the image forming apparatus. More specifically, there are shown a paper type determining sensor 5, a variable transfer pressure application mechanism 66, a paper type memory section 105 and a variable transfer pressure application mechanism control section 166. An image forming apparatus according to the present invention is so controlled that, as the paper type is determined according to the signal from the paper type determining sensor 5, information showing the paper type is stored in the paper type memory section 105 and subsequently the variable transfer pressure application mechanism control section 166 controls the variable transfer pressure application mechanism 66 so as to realize the corresponding transfer roller pressure as listed in Table 1.

It may alternatively be so arranged that information showing the paper type stored in the paper type memory section 105 is given by a command issued from a host apparatus such as a host computer instead of being given from the paper type determining sensor 5.

With the above-described arrangement where a paper type memory section 5 is arranged to store the type of recording medium onto which an image is to be transferred at the secondary transfer unit 60, the transfer pressure is controlled and, if necessary, changed by the variable transfer pressure application mechanism 66 according to the type of recording medium stored in the paper type memory section 5 so that the transfer process can be executed in optimum transfer conditions according to the type of recording medium.

Thus, an image forming apparatus according to the present invention does not require any temperature control unlike the conventional art and hence an image can be transferred onto a recording medium of any of various different types efficiently by controlling and, if necessary, changing the transfer pressure according to the type of recording medium.

As the transfer pressure is changed according to the type of recording medium, there can arise a problem of color shift when the type of recording medium to be used in the image forming apparatus is changed. This is because the transfer position of each of the toner images of the different colors is delicately shifted when the transfer pressure is switched. The present invention proposes a technique of dissolving such a color shift problem.

JP-A-2006-126258 discloses an image forming device designed to dissolve the color shift problem. According to the above-cited JP-A-2006-126258, there is provided a wet-developing image forming device including image forming stations of the different colors, each including a charging section, an image writing section and a development section around a latent image carrier such as a photosensitive drum, arranged along a transfer medium such as a transfer belt. The toner images formed at the image forming stations of the different colors are laid one on the other on the transfer medium to form a color image.

A serious problem of an image forming apparatus having a plurality of image forming stations is that of color shift. The problem of color shift arises as the transfer positions of the toner images of the different colors formed at the respective image forming stations are displaced from each other and entails a problem of varied color tones of the formed image. An image forming apparatus according to the above cited patent document is designed to register toner images of the different colors by forming reference pattern images (to be referred to as "registration marks" hereinafter) for detecting any color shift on the transfer medium and obtaining positional information on the registration marks by detecting the registration marks by an optical sensor so as to register the toner images of different colors (a color shift correction process, a positional displacement correction process) according to the positional information.

Figure 12:
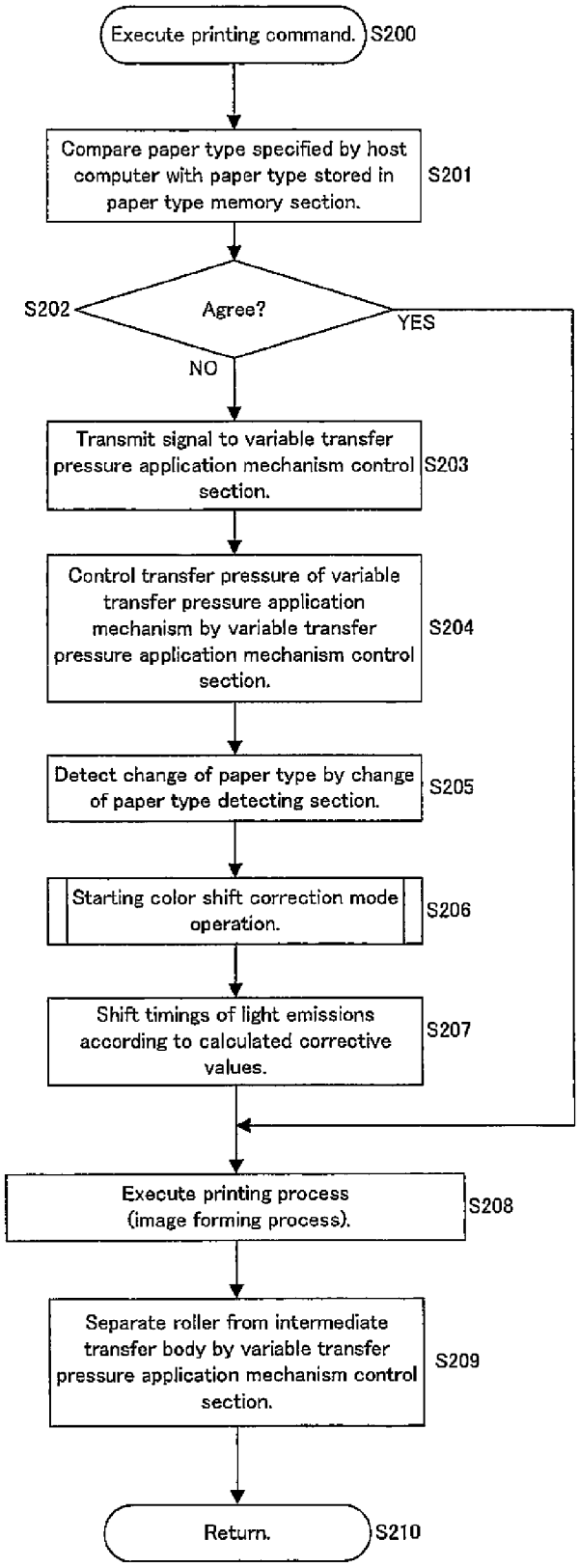
FIG. 12 is a flowchart of the subroutine of the printing command execution process of the image forming apparatus according to another embodiment of the present invention.

In JP-A-2006-126258, a process of correcting color shift of the image forming apparatus is described by referring to FIG. 12 of the accompanying drawings. According to the above cited patent document, registration marks YRM, MRM, CRM and KRM are formed as toner images by executing ordinary image forming operations on an intermediate transfer belt 41 sequentially in the order of yellow, magenta, cyan and black immediately after the power switch of the apparatus is turned on. At this time, the timings of forming the images are controlled so as to form the registration marks YRM, MRM, CRM and KRM on a reference position S0. However, registration marks MRM, CRM and KRM can be formed with errors Sm, Sc and Sk relative to the reference positions S0 that take place in the light beam scanning direction X as shown in FIG. 2 due to assembling errors and the like. Then, the errors Sm, Sc and Sk can be corrected and dissolved by measuring them by means of a sensor such as a CCD camera and shifting the image forming timings (the light beam 21 scanning timings) so as to shift the image positions respectively by the errors Sm, Sc and Sk.

According to the present invention, the color shift problem as pointed out in JP-A-2006-126258 can be solved by introducing a color shift correction mode as will be described below.

Now, a color shift correction mode according to the present invention will be described below. A color shift problem can take place in image forming apparatus wherein development devices 30Y, 30M, 30C and 30K of four colors are operated to form images. More specifically, as the toner images of the different colors formed by the different development devices 30Y, 30M, 30C and 30K are transferred onto the intermediate transfer body 40, their transfer positions are displaced relative to each other and consequently a problem of varied color tones of the image occurs on a recording medium.

To solve this problem, an image forming apparatus according to the present invention is adapted to operate in a color shift correction mode in which reference pattern images (to be referred to as "registration marks" hereinafter) are formed on the intermediate transfer body 40 in order to detect color shifts in advance and positional information on the registration marks is obtained by detecting the registration marks by means of an optical sensor 90 in order to register the toner images of the different colors (a color shift correction process, a positional displacement correction process) according to the positional information.

The optical sensor 90 for detecting the registration marks is arranged upstream relative to the transfer nip of the secondary transfer unit 60 as shown in FIG. 1. Known devices that can be used for the optical sensor 90 include a pair of a light-emitting element and a light-receiving element and a CCD camera.

In a color shift correction mode of an image forming apparatus according to the present invention, registration marks YRM, MRM, CRM and KRM are formed as toner images on the intermediate transfer body 40 in the order of yellow, magenta, cyan and black typically immediately after turning on the image forming apparatus or when the transfer pressure of the variable transfer pressure application mechanism 66 is changed by executing an image forming process. The registration marks formed in the above-described manner are then detected by the optical sensor 90 to calculate the amount of the color shift of each of the registration marks of the different colors.

Figure 5:
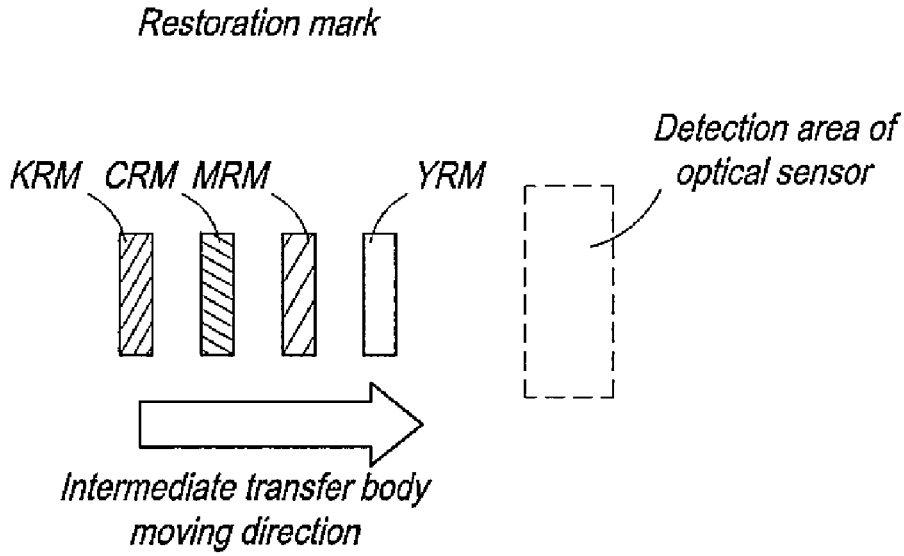
FIG. 5 is a schematic illustration of registration marks and the process of detecting them.

Now, the method of calculating the amount of the color shift of each of the registration marks of the different colors in a color shift correction mode will be described below. The operation of the image forming apparatus in a color shift correction mode is independent from the operation of the image forming apparatus in a printing mode. In a color shift correction mode, registration patterns, or registration marks, of the different colors are put on the intermediate transfer body 40 as shown in FIG. 5 and read out by means of an optical sensor 90 arranged at a position opposite to the belt drive roller 41. Since the operation in a color shift correction mode is not a real printing operation, no recording medium is supplied to the intermediate transfer body 40. In a color shift correction mode, the registration marks on the intermediate transfer body 40 are read out by the optical sensor 90 and then scraped off by the intermediate transfer body cleaning blade 46 after passing through the nip portions of the secondary transfer unit 60.

Figure 6:
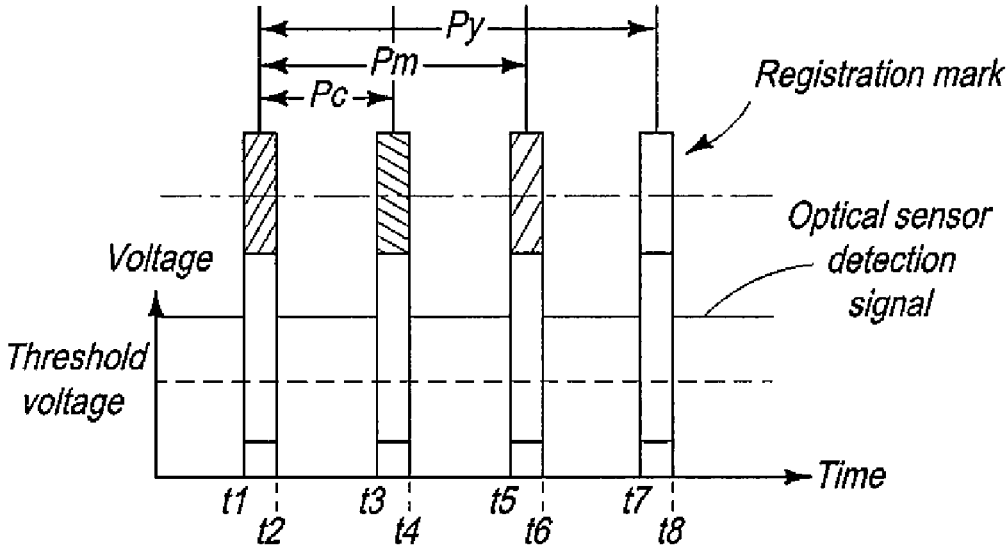
FIG. 6 is a schematic illustration of the relationship between registration marks and optical sensor detection signals.

FIG. 6 is a schematic illustration of the relationship between registration marks and detection signals output from the optical sensor 90. As shown in FIG. 6, a threshold voltage is provided for the read out signals and the registration marks are detected by detecting the rising clock times t1 through t8 of the pattern of the different colors. In FIG. 6, Pc represents the distance from the center of the KM to the center of the CRM and Pm represents the distance from the center of the KRM to the center of the MRM, while Py represents the distance from the center of the KRM to the center of the YRM in the color shift correction mode. Table 2 below shows the design value of the distance between the center of the CMY and the center of the KRM, using the black (K) registration mark as reference. Table 3 below shows the observed actual value of the distance between the center of the CMY and the center of the KRM, using the black (K) registration mark as reference. Table 4 shows the corrective amount of the CMY, using the black (K) region mark as reference.

TABLE 2

| K reference pitch (design value) | |
|---|---|
| Cyan | pc |
| Magenta | pm |
| Yellow | py |

TABLE 3

| K reference pitch (design value) | |
|---|---|
| Cyan | Pc |
| Magenta | Pm |
| Yellow | Py |

TABLE 4

| K reference color shift correction amount | |
|---|---|
| Cyan | Rc |
| Magenta | Rm |
| Yellow | Ry |

With the above definitions, the corrective amounts of the registration marks of the different colors Rc, Rm and Ry can be determined respectively from the differences of the mark detection clock times of the different colors by referring to the color K and the corresponding design values as shown below;

cyan corrective amount: $Rc=Vp\times\{(t3-t1)+(t4-t2)\}/2-Pc,$ magenta corrective amount: $Rm=Vp\times\{(t5-t1)+(t6-t2)\}/2-Pm$ and yellow corrective amount: $Ry=Vp\times\{(t7-t1)+(t8-t2)\}/2-Py,$ where Vp is the moving speed of the intermediate transfer body 40.

The corrective amounts of the registration marks of the different colors Rc, Rm and Ry that are calculated in the above-described manner are then stored in a memory means of the control section of the image forming apparatus and the displacements, or the color shifts, of the toner images of the different colors are corrected by means of the stored corrective amounts in the actual printing operation.

Now, the color shift amount correction method in a color shift correction mode will be described below. In the color shift correcting operation in a color shift correction mode, the shift amounts on the intermediate transfer body 40 can be corrected by driving the exposure units 12Y, 12M and 12C to operate, taking the above corrective shift amounts into consideration, so as to shift the timings (of light emissions) for forming latent images on the image carriers 10Y, 10M, 10C and 10K.

The image forming apparatus is driven to operate in a color shift correction mode by calculating the corrective amounts of the registration marks of the different colors and shifting the write timings of the exposure units according to the determined corrective amounts so that consequently, the toner images of the three colors of C, M and Y are transferred to the right position without any displacement relative to the toner image of K. In this way, the image forming apparatus of this embodiment can provide a full color image that is free from color shift.

The color shifts can be corrected in a color shift correction mode by modifying the moving speed of the intermediate transfer body 40 when transferring images from the image carriers to the intermediate transfer body 40. More specifically, the corrective amounts of the registration marks are calculated and then are reflected to the drive pulse of the drive motor 48 that drives the belt drive roller 41 to rotate so as to make it drive the belt drive roller 41 at the designed number of revolutions per unit time. Then, the intermediate transfer body 40 is constantly driven to move at a given speed regardless of the pressure applied thereto by the secondary transfer unit 60. Then, the obtained image is free from the color shift.

Figure 7:
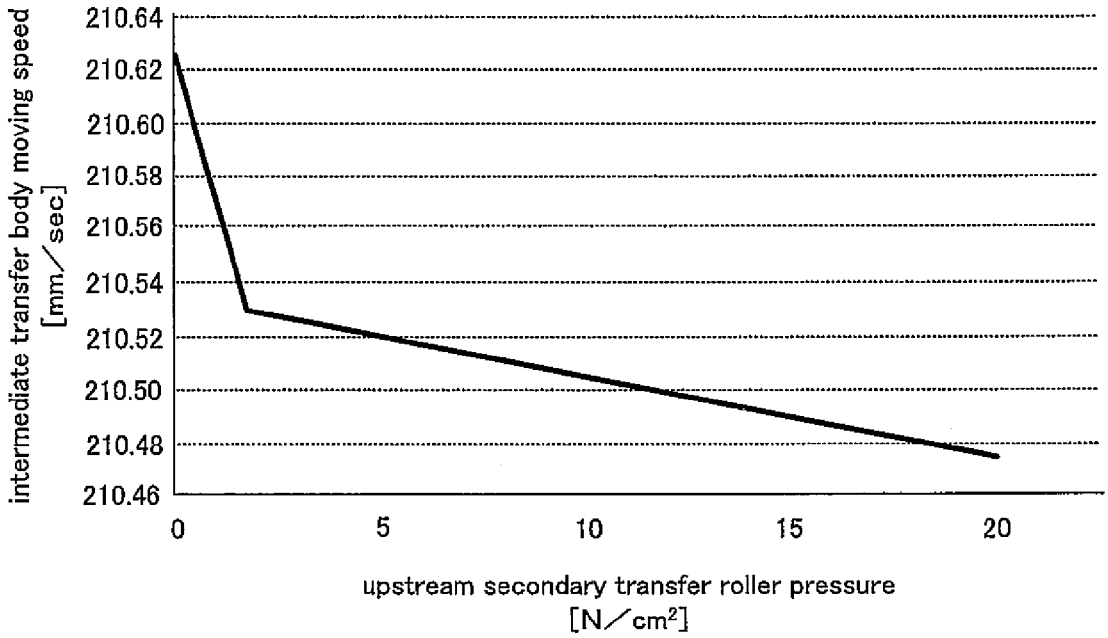
FIG. 7 is a graph illustrating the relationship between the moving speed of the intermediate transfer body 40 and the pressure of the upstream secondary transfer roller 61.

Meanwhile, an image forming apparatus according to the present invention is adapted to print images on recording mediums, or sheets of paper, of differ paper types (coat paper such as art paper, non-coat paper such as high-quality paper and plain paper, etc.) by varying the pressure that the upstream secondary transfer roller 61 applies by means of a variable transfer pressure application mechanism 6. More specifically, the pressure that the upstream secondary transfer roller 61 applies can be adjusted over a considerably wide range between 1.7 and 20.0 N/cm$^2$. Then, the load to be borne by the intermediate transfer body 40 varies to a large extent between the high pressure level and the low pressure level of the upstream secondary transfer roller 61 to by turn vary the absolute speed of the intermediate transfer body 40 between the high pressure level and the low pressure level. FIG. 7 shows a graph illustrating the relationship between the moving speed of the intermediate transfer body 40 and the pressure of the upstream secondary transfer roller 61.

Thus, when the information on the paper type stored in the paper type memory section 105 is changed, the amounts of color shifts vary between the pre-change values and the post-change values. For this reason, a color shift correction mode is introduced into the image forming apparatus in order to correct the color shifts before actually driving the image forming apparatus for a printing operation.

More specifically, the image forming apparatus of this embodiment is driven to operate in a color shift correction mode each time the roller pressure of the secondary transfer roller is varied. The paper type is determined by the paper type determining sensor 5 and, since the information on the paper type stored in the paper type memory section 105 is changed when the outcome of the determination tells that the recording medium used for printing last time differs from the recording medium to be used in the printing operation that is to be started or when the user changes the paper type of recording medium to be used in the printing operation that is to be started from that of the recording medium used for printing last time on the host computer, the image forming apparatus is driven to operate in a color shift correction mode before starting an actual printing operation.

In a color shift correction mode, the upstream secondary transfer roller 61 is brought into contact with the intermediate transfer body 40 to apply pressure of the level that corresponds to the information on the paper type stored in the paper type memory section 105, while the downstream secondary transfer roller 65 is brought into contact to apply pressure of the predetermined level (1.0 N/cm$^2$), and the corrective amounts of the registration marks are calculated and stored. Then, the apparatus is stopped once before starting a printing operation of actually printing a color image. With this arrangement, the most updated condition of the apparatus is taken into account when correcting the registration marks so that a highly accurate image that is free from any color shift can be obtained.

In this way, the image forming apparatus is operated in a color shift correction mode when the transfer pressure of the upstream secondary transfer roller 61 is varied by the variable transfer pressure application mechanism 66 to effectively prevent any color shift from taking place.

Preferably, the image forming apparatus is operated in a color shift correction mode when the apparatus is turned on (when the power supply is turned on). With such an arrangement, the image forming apparatus operates automatically in a color shift correction mode when the user turns on the power supply of the apparatus.

More specifically, the upstream secondary transfer roller 61 is brought into contact with the intermediate transfer body 40 to apply pressure of 1.7 N/cm$^2$ for coat paper and then successively apply pressure of 20.0 N/cm$^2$ for non-coat paper in the color shift correction mode. Thus, when the power supply is turned on, both the corrective amounts of the registration marks for coat paper and the corrective amounts of the region marks for non-coat paper are stored but then the image forming apparatus is not operated in a color shift correction mode until the power supply is turned on next. Then, the time required for adjusting the operation of the image forming apparatus for color registration can be reduced to improve the productivity of printing operation.

Thus, an image forming apparatus according to the present invention is provided with a paper type memory means for storing the paper type of recording medium, or the sheet of paper, to be used for transferring an image by the secondary transfer means and the transfer pressure is varied by the variable transfer pressure application mechanism according to the paper type of recording medium stored in the paper type memory means. Thus, the image is optimally transferred according to the paper type of recording medium.

Additionally, an image forming apparatus according to the present invention is driven to operate in a color shift correction mode to correct the corrective amounts of the registration marks when the transfer pressure is varied by the variable transfer pressure application mechanism to prevent any color shift from taking place.

Figure 8:
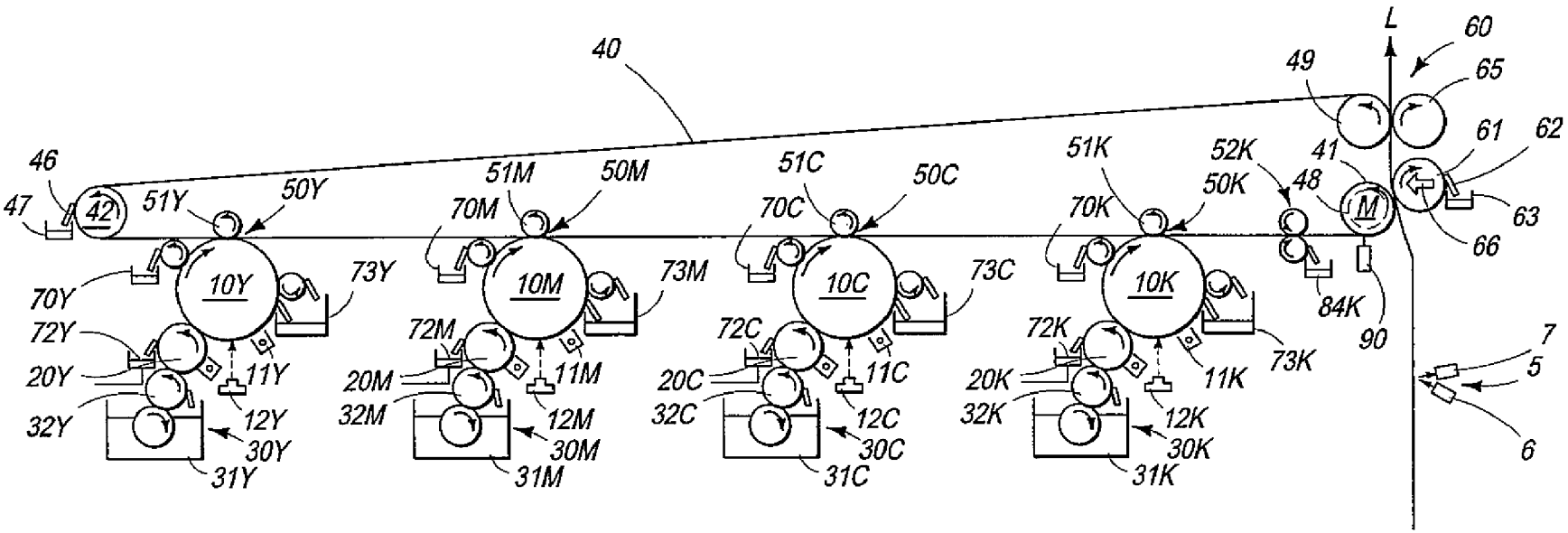
FIG. 8 is a schematic illustration of an image forming apparatus according to another embodiment of the present invention, showing principal components thereof.

FIG. 8 is a schematic illustration of another embodiment of image forming apparatus according to the present invention, showing principal components thereof. The components of this embodiment denoted by reference symbols same as those of the above-described embodiment are same as the corresponding components of the first embodiment. This embodiment differs from the above-described embodiment in terms of the configuration of the secondary transfer unit 60, more particularly in terms of the positional relationship of the belt drive roller 41 and the upstream secondary transfer roller 61.

While the axis of rotation of the belt drive roller 41 and that of the upstream secondary transfer roller 61 are held at the same vertical level in the above-described embodiment, the axis of rotation of the upstream secondary transfer roller 61 is held higher than that of the belt drive roller 41 in this embodiment. With this embodiment, the secondary transfer nip length N between the intermediate transfer body 40 (or the belt drive roller 41) and the upstream secondary transfer roller 61 is extended to improve the transfer efficiency of this embodiment.

Additionally, the variable transfer pressure application mechanism 66 is adapted to be able to completely separate the upstream secondary transfer roller 61 from the intermediate transfer body 40. As a result, when the image forming apparatus of this embodiment is not operating for printing, the upstream secondary transfer roller 61 can be completely separated from the intermediate transfer body 40 to prevent the surface layer of the upstream secondary transfer roller 61 from being deformed.

Still additionally, the flow of operation of the apparatus is modified because of the introduction of the above-described separation features.

Figure 9A:
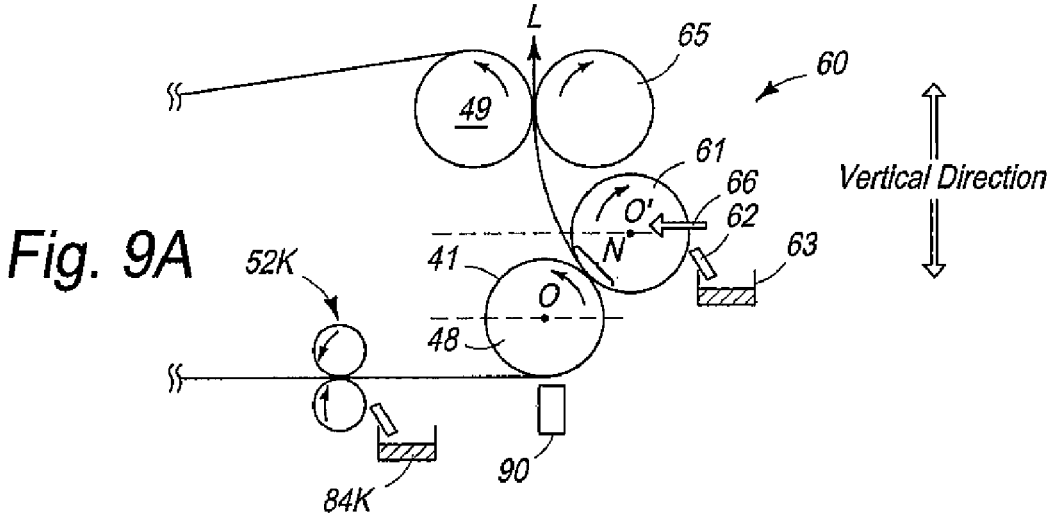
FIGS. 9A, 9B and 9C are schematic illustrations of alternative arrangements of the secondary transfer unit 60 of the image forming apparatus according to another embodiment of the present invention, showing the configuration thereof.
Figure 9B:
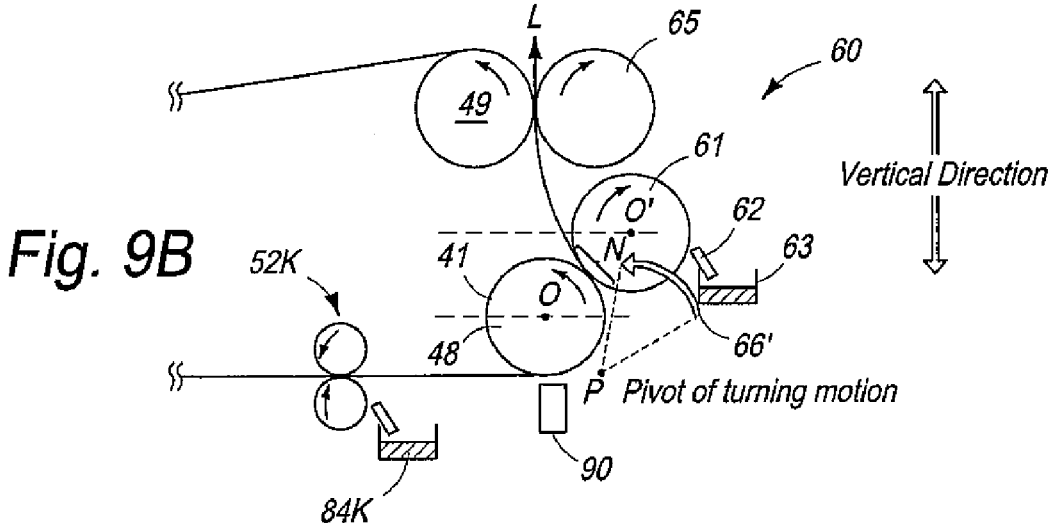
Figure 9C:
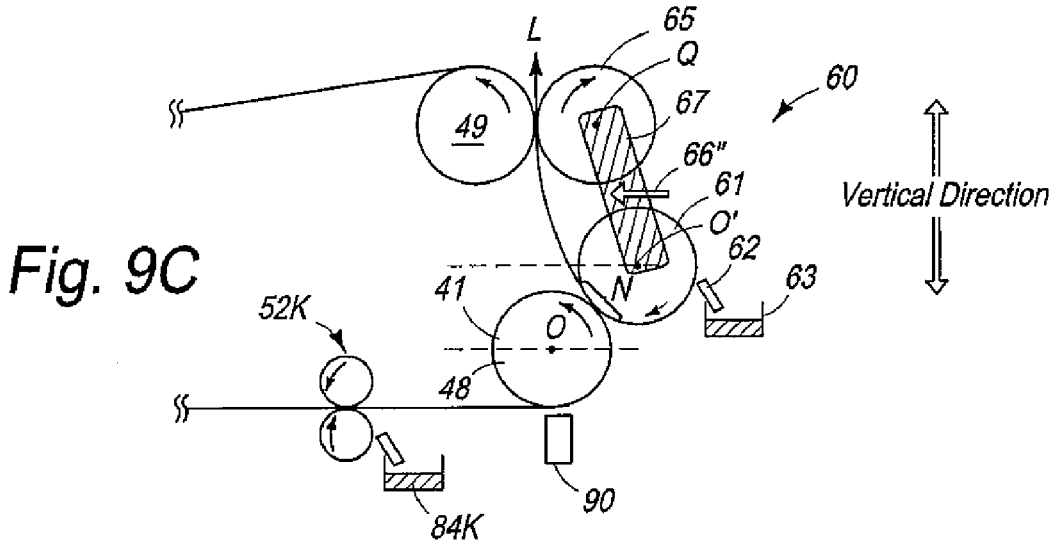

Now, this embodiment of image forming apparatus will be described in detail below. FIGS. 9A, 9B and 9C are schematic illustrations of alternative arrangements of the secondary transfer unit 60 of the image forming apparatus of this embodiment, showing the configuration thereof.

FIG. 9A shows an arrangement of the secondary transfer unit 60 of this embodiment where the axis of rotation (O') of the upstream secondary transfer roller 61 is held higher than the axis of rotation (O) of the belt drive roller 41 and a slide type variable transfer pressure application mechanism 66 is adopted so that the upstream secondary transfer roller 61 may move on a predetermined plane. With this arrangement, the upstream secondary transfer roller 61 can be brought into contact and moved away from the belt drive roller 41 via the intermediate transfer body 40. Thus, the secondary transfer nip length N of the secondary transfer unit 60 can be made relatively long to improve the transfer efficiency.

FIG. 9B shows an arrangement of the secondary transfer unit of this embodiment where the axis of rotation (O') of the upstream secondary transfer roller 61 is held higher than the axis of rotation (O) of the belt drive roller 41 and a rotary type variable transfer pressure application mechanism 66 is adopted so as to turn around a pivot located at point P in FIG. 9B. With this arrangement, the upstream secondary transfer roller 61 can be brought into contact and moved away from the belt drive roller 41 by way of the intermediate transfer body 40. Thus, the secondary transfer nip length N of the secondary transfer unit 60 can be made relatively long to improve the transfer efficiency. Additionally, the adoption of a rotary type variable transfer pressure application mechanism 66 provides an advantage that the pressure applied by the upstream secondary transfer roller 61 to the intermediate transfer body 40 can be adjusted with ease.

FIG. 9C shows an arrangement of the secondary transfer unit of this embodiment where the axis of rotation (O') of the upstream secondary transfer roller 61 is held higher than the axis of rotation (O) of the belt drive roller 41 and both the upstream secondary transfer roller 61 and the downstream secondary transfer roller 65 are commonly pinched by a pair of pinch plates 67, which pair of pinch plates 67 operates as a slide type variable transfer pressure application mechanism 66" for applying pressure onto the belt drive roller 41 and the follower roller 49. With this arrangement, the upstream secondary transfer roller 61 and the downstream secondary transfer roller 65 can respectively be brought into contact and moved away from the belt drive roller 41 and the follower roller 49 via the intermediate transfer body 40. Thus, the secondary transfer nip length N of the secondary transfer unit 60 can be made relatively long to improve the transfer efficiency. Additionally, the condition of the nip portion formed between the downstream secondary transfer roller 65 and the intermediate transfer body 40 can easily be controlled by the slide type variable transfer pressure application mechanism 66" so that the recording medium can be peeled off from the intermediate transfer body 40 with ease under control.

Figure 10:
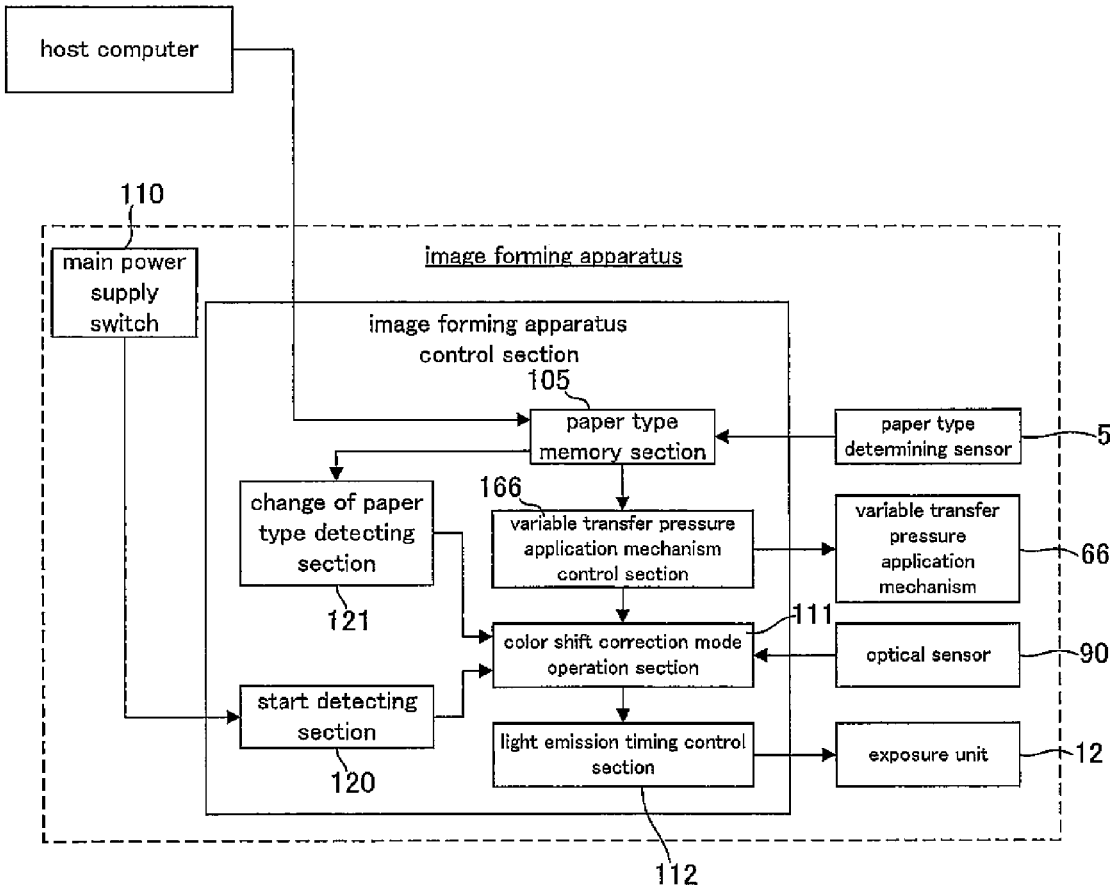
FIG. 10 is a schematic block diagram of the paper type memory section and some of the related components thereof of the image forming apparatus according to another embodiment of the present invention.

Now, the operation of controlling the image forming apparatus of this embodiment having the above-described configuration will be described below FIG. 10 is a schematic block diagram of the paper type memory section and some of the related components thereof of the image forming apparatus of this embodiment. In FIG. 10, the block surrounded by dotted lines indicates the image forming apparatus. More specifically, there are shown an exposure unit 12, a variable transfer pressure application mechanism 66, an optical sensor 90, a paper type memory section 105, a main power supply switch 110, a color shift correction mode operation section 111, a light emission timing control section 112, a start detecting section 120, a change of paper type detecting section 121 and a variable transfer pressure application mechanism control section 166.

As the paper type is determined by the paper type determining sensor 5, information on the paper type is stored in the paper type memory section 105. Alternatively, the paper type specified by a paper type specification command issued from a host apparatus such as a host computer may be stored in the paper type memory section 105. The variable transfer pressure application mechanism control section 166 controls the variable transfer pressure application mechanism 56 according to the information on the paper type stored in the paper type memory section 105 so as to realize the state as defined in Table 1.

The change of paper type detecting section 121 is an operation block for detecting that the paper type stored in the paper type memory section 105 is changed and the start detecting section 120 is an operation block for detecting that the main power supply switch 110 of the image forming apparatus is turned on. When the change of paper type detecting section 121 detects that the paper type is changed or the start detecting section 120 detects that the main power supply switch 110 is turned on to start the image forming apparatus, it triggers an operation of the color shift correction mode operation section 111. The color shift correction mode operation section 111 acquires correction values for various shifts by executing a color shift correction mode routine. The light emission timing control section 112 operates to change the timings of light emissions of the exposure units 12 to dissolve various shifts as such correction values are input to them.

Figure 11:
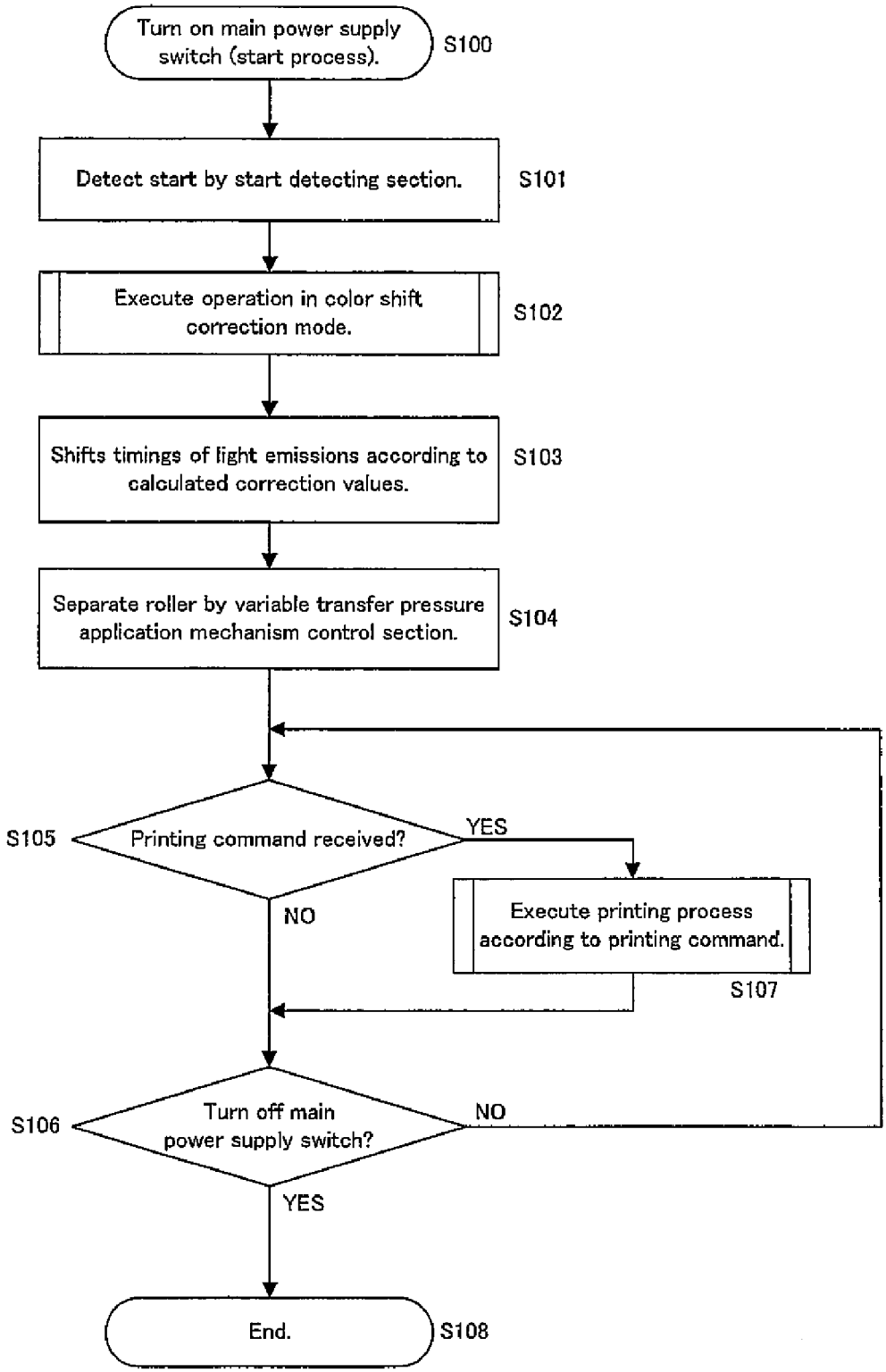
FIG. 11 is a flowchart of the main routine of the image forming process of the image forming apparatus according to another embodiment of the present invention.

Now, the flow of the process of the image forming apparatus of this embodiment having a configuration as illustrated in the block diagram will be summarily described below. FIG. 11 is a flowchart of the main routine of the image forming process of the image forming apparatus of this embodiment.

Referring to FIG. 11, as the main power supply switch 110 is turned on to start the process in Step S101, the start detecting section 120 detects the start of the image forming apparatus in the next step, or Step S101. The detection by the start detecting section 120 triggers an execution of a subroutine in a color shift correction mode in Step S102. This subroutine will be described in greater detail hereinafter.

As the operation returns from the subroutine, the light emission timing control section 112 shifts the timings of light emissions according to the correction values calculated in the subroutine in Step S103. In Step S104, the variable transfer pressure application mechanism control section 166 separates the upstream secondary transfer roller 61 from the intermediate transfer body 40. As a result, the surface layer of the upstream secondary transfer roller 61 is prevented from being deformed. After Step S104, the image forming apparatus is put into a standby status where it waits for a printing command.

In Step S104, it is determined if a printing command is received or not. The process proceeds to Step S107 when the answer to the question is YES, whereas it proceeds to Step S106 when the answer to the question is NO. In Step S107, a subroutine for a printing command execution process is executed.

In Step S106, it is determined if the main power supply switch 110 is turned off or not. The process proceeds to Step S108, where it is ended, when the answer to the question is YES.

Now, the subroutine of the printing command execution process that is executed in Step S107 will be described in detail below. FIG. 12 is a flowchart of the subroutine of the printing command execution process of the image forming apparatus of this embodiment.

Now, referring to FIG. 12, as the subroutine of the printing command execution process is started in Step S200, the paper type specified by the printing command from the host computer is compared with the paper type stored in the paper type memory section 105 in the next step, or Step S201 and it is determined if the outcome of the comparison shows agreement of the paper types or not in Step S202. The process proceeds to Step S208, where a printing operation (an image forming operation) is executed, when the answer to the question is YES in Step S202.

The process proceeds to Step S203, where a predetermined signal is transmitted to the variable transfer pressure application mechanism control section 166, when the answer to the question is NO in step S202. Upon receiving the signal, the variable transfer pressure application mechanism control section 166 controls the variable transfer pressure application mechanism 66 so as to modify the pressure being applied to the belt drive roller 41 in step S204.

When the change of paper type detecting section 121 detects a change of paper type in Step S205, it triggers an operation of starting the color shift correction mode operation section 111 in Step S206 so as to have a subroutine executed in a color shift correction mode. As the process returns from the subroutine, the light emission timing control section 112 shifts the timings of light emissions in step S207 according to the correction values calculated in the subroutine. After the timings of light emissions are shifted, the printing process (the image forming process) is executed in step S208.

In Step S209, the variable transfer pressure application mechanism control section 166 separates the upstream secondary transfer roller 61 from the intermediate transfer body 40. As a result, the surface layer of the upstream secondary transfer roller 61 is prevented from being deformed. The subroutine returns to the main routine in Step S210.

Figure 13:
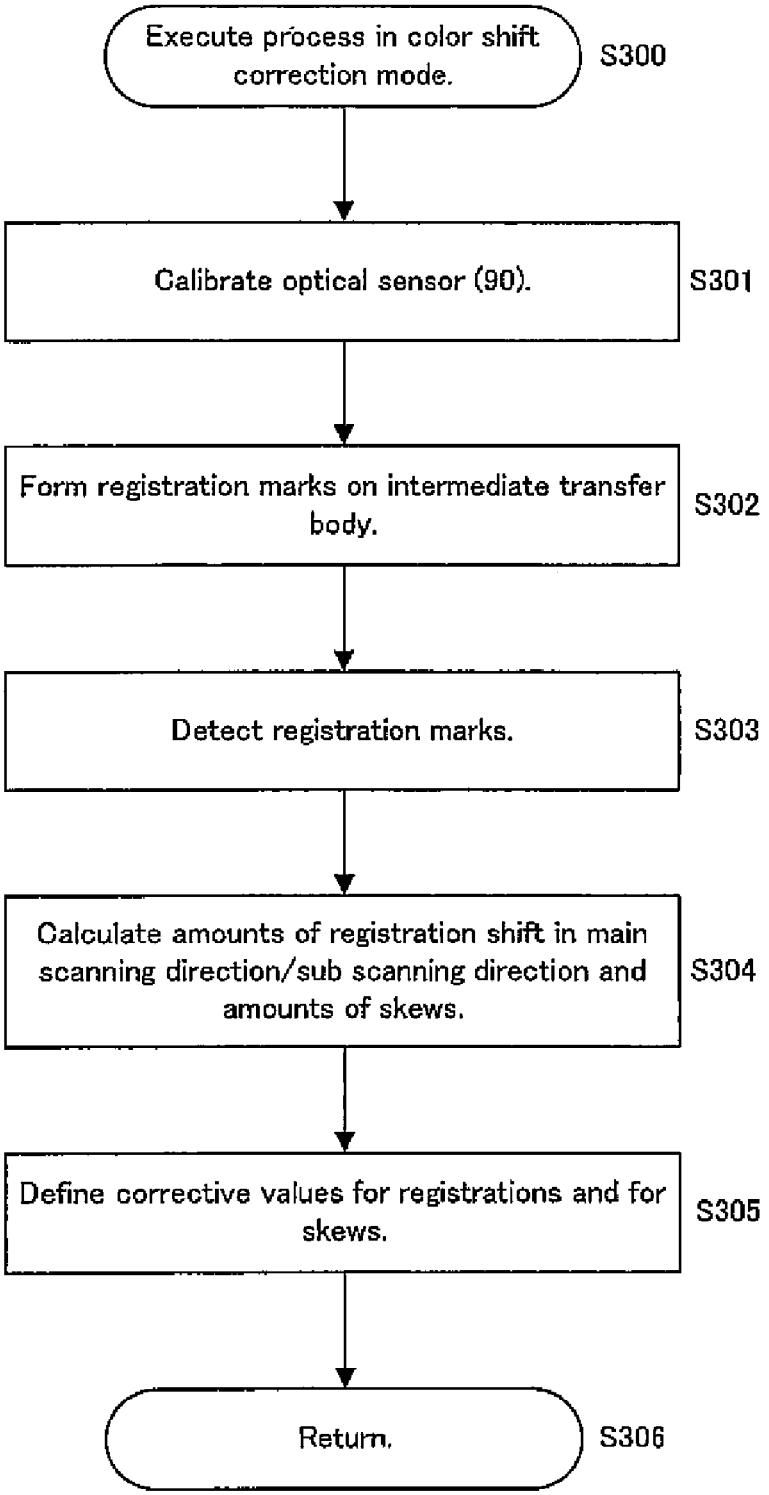
FIG. 13 is a flowchart of the subroutine of the process in a color shift correction mode of the image forming apparatus according to another embodiment of the present invention.

Now, the subroutine that is executed in a color shift correction mode will be described in greater detail below. FIG. 13 is a flowchart of the subroutine of the process in a color shift correction mode of the image forming apparatus of this embodiment. Referring to FIG. 13, as the subroutine is started in a color shift correction mode, the optical sensor 90 for detecting registration marks is calibrated (Step S301) and the light emission level of the sensor is adjusted until the surface output of the intermediate transfer body 40 gets to a predetermined voltage level. Then, registration marks are formed on the intermediate transfer body 40 (Step S302) and detected by the optical sensor 90 (Step S303). The shift amounts of the registration marks are calculated in the main scanning direction and also in the sub scanning direction along with the amounts of the skews of the registration marks from the outcome of the detection of the optical sensor 90 (Step S304). Then, the corrective amounts of the registration marks of the different colors are defined (shift amounts of the registration marks in the main scanning direction and in the sub scanning direction along with the corrective amounts of the skews) (Step S305).

Figure 14:
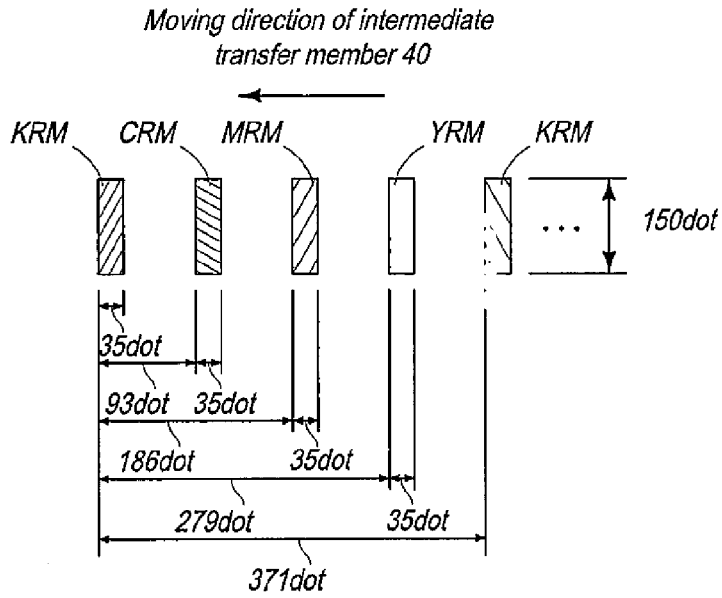
FIG. 14 is a schematic illustration of registration marks for detecting registration shifts (skews) in the sub scanning direction.
Figure 15:
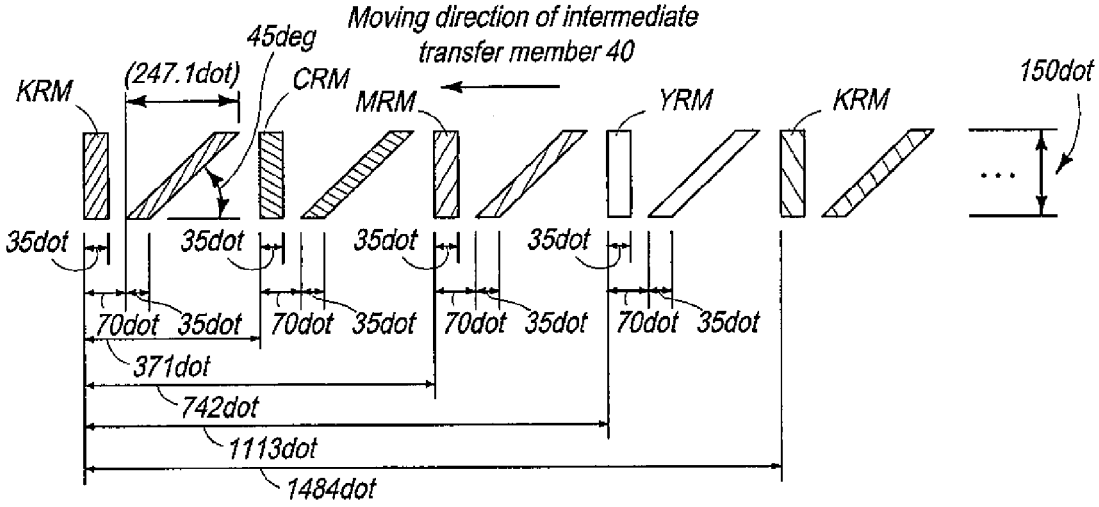
FIG. 15 is a schematic illustration of registration marks for detecting registration shifts in the main scanning direction.

FIG. 14 is a schematic illustration of registration marks for detecting registration shifts (skews) in the sub scanning direction and FIG. 15 is a schematic illustration of registration marks for detecting registration shifts in the main scanning direction.

(Method of Calculating Amounts of Registration Shifts of Registration Marks)

Now, the method of calculating the amounts of the registration shifts of the registration marks in the main scanning direction and also in the sub scanning direction along with the amounts of the skews of the registration marks will be described below. The amounts of the registration shifts of the registration marks of the different colors can be calculated from the results of detecting the predetermined registration marks (temporal information on the edges of the registration marks). The method will be described in terms of an instance where K is used as reference color.

Method of Calculating Amounts of Registration Shifts in Main Scanning Direction

Figure 16:
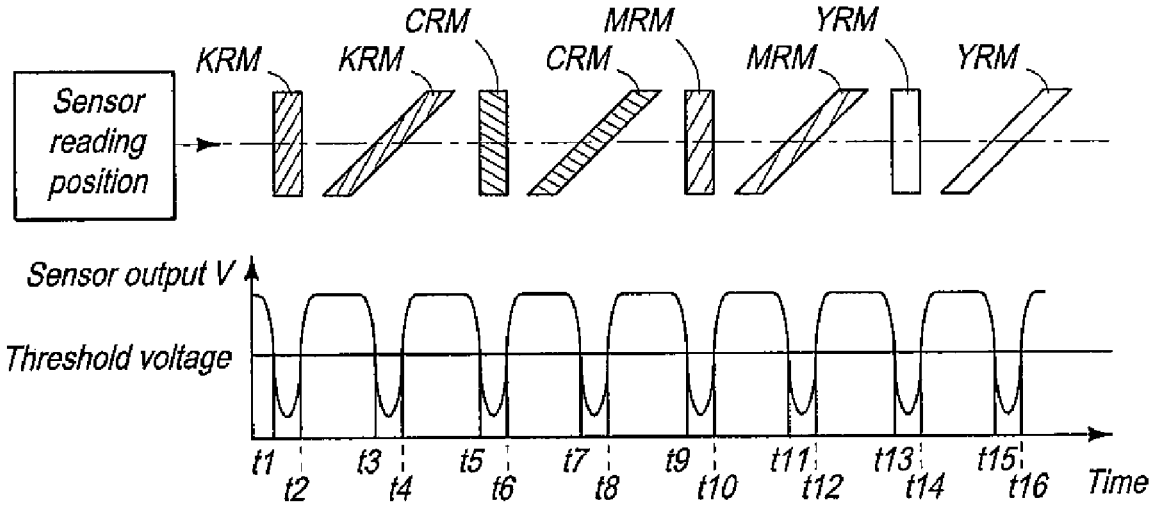
FIG. 16 is a schematic illustration of outputs of the optical sensor 90 for detecting registration marks.

The amounts of registration shifts in the main scanning direction can be calculated from the results of detection of marks that are combinations of straight lines and oblique lines. Table 5 is a schematic illustration of parameters to be used for detecting registration marks, using black (K) as reference. FIG. 16 is a schematic illustration of outputs of the optical sensor 90 for detecting registration marks that are obtained when registration marks are detected by means of the optical sensor 90.

TABLE 5

| | temporal pitch of straight line - oblique line (measured value) | amount of registration shift (using K as reference) |
|---|---|---|
| black (K) | Lk | — |
| cyan (C) | Lc | Dc |
| magenta (M) | Lm | Dm |
| yellow (Y) | Ly | Dy |

Firstly, the temporal pitch of the straight line and the oblique line of each of the colors is calculated from the temporal information on the edges of the detected corresponding registration mark in a manner as shown below.

$$Lk=\{(t3-t1)+(t4-t2)\}/2$$

$$Lc=\{(t7-t5)+(t8-t6)\}/2$$

$$Lm=\{(t11-t9)+(t12-t10)\}/2$$

$$Ly=\{(t15-t13)+(t16-t14)\}/2$$

Then, the amount of registration shift in the main scanning direction of each of the colors is determined from the corresponding temporal pitch in a manner as shown below.

$$Dc=Lc-Lk$$

$$DM=Lm-Lk$$

$$Dy=Ly-Lk$$

Then, the corrective value of the registration mark of each of the colors is defined from the above amount of registration shift and the light emitting position in the main scanning direction of the exposure unit such as the line head (LED, OPH) of each of the colors other than the reference color is modified to correct the registration shift in the main scanning direction.

Method of Calculating Amounts of Registration Shifts in Sub Scanning Direction

Figure 17:
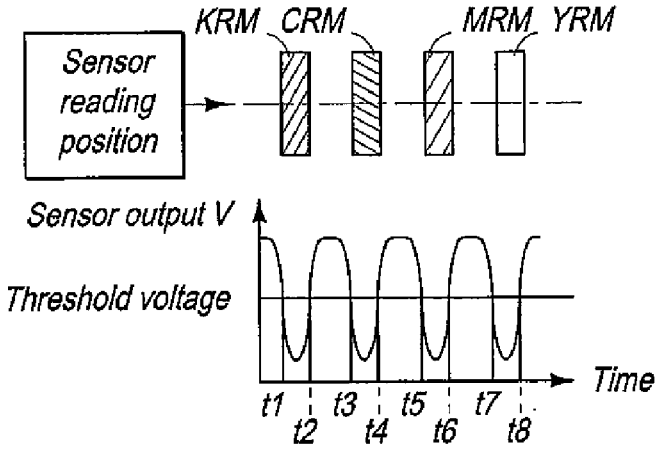
FIG. 17 is a schematic illustration of outputs of the optical sensor 90 for detecting registration marks.

The amounts of registration shifts in the sub scanning direction can be calculated from the results of detection of marks of straight lines. Table 6 is a schematic illustration of parameters to be used for detecting registration marks, using black (K) as reference. FIG. 17 is a schematic illustration of outputs of the optical sensor 90 for detecting registration marks

TABLE 6

| | temporal pitch (using K as reference) (design value) | temporal pitch (using K as reference) (measured value) | amount of registration shift (using K as reference) |
|---|---|---|---|
| cyan (C) | pc | Pc | Rc |
| magenta (M) | pm | Pm | Rm |
| yellow (Y) | py | Py | Ry |

Firstly, the temporal pitch of each of the colors and the reference color is calculated from the temporal information on the edges of the registration mark obtained as a result of detection in a manner as shown below $$Pc=\{(t3-t1)+(t4-t2)\}/2$$

$$Pm=\{(t5-t1)+(t6-t2)\}/2$$

$$Py=\{(t7-t1)+(t8-t2)\}/2$$

Then, the amount of registration shift in the sub scanning direction of each of the colors is determined from the corresponding temporal pitch and the corresponding design value in a manner as shown below.

$$Rc=Pc-pc$$

$$Rm=Pm-pm$$

$$Ry=Py-py$$

Then, the corrective value of the registration mark of each of the colors is defined from the above amount of registration shift and the timing of light emission in the sub scanning direction of the exposure unit such as the line head (LED, OPH) of each of the colors other than the reference color is modified to correct the registration shift in the sub scanning direction.

Amounts of Skews

Figure 18:
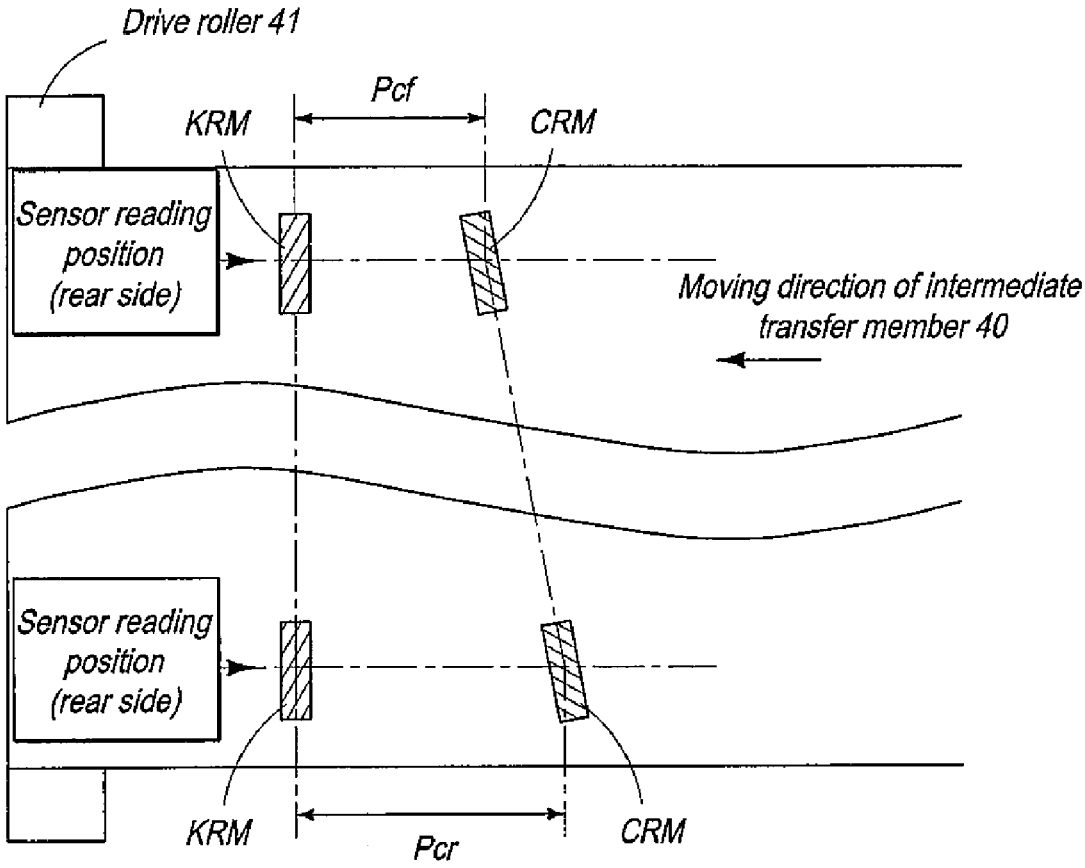
FIG. 18 is a schematic illustration of the operation of the optical sensor 90 for detecting registration marks.

The amount of the skew of each of the registration marks can be calculated by forming sub scanning direction registration marks at the opposite ends of the belt and seeing the outcome of the detection of the registration marks at the opposite ends. Table 7 is a schematic illustration of parameters to be used for detecting registration marks, using black (K) as reference. FIG. 18 is a schematic illustration of the operation of the optical sensor 90 for detecting registration marks. The two outputs including the output of the front side sensor and that of the rear side sensor that are arranged at the axial opposite ends of the roller as optical sensor 90 are used.

TABLE 7

| | temporal pitch (using K as reference) (measured value at front side) | temporal pitch (using K as reference) (measured value at rear side) | amount of skew (using K as reference) |
|---|---|---|---|
| cyan (C) | Pcf | Pcr | Sc |
| magenta (M) | Pcm | Pmr | Sm |
| yellow (Y) | Pcy | Pyr | Sy |

The temporal pitch of the registration mark of each of the colors other than the reference color and that of the reference color is calculated from the temporal information on the edges of the registration marks obtained at the opposite ends (of the front side and the rear side) in the direction orthogonal relative to the moving direction of the intermediate transfer body 40. Then, the amount of the skew of the registration mark of each of the colors is calculated from the difference of the temperature pitches at the opposite ends of the belt in a manner as shown below.

$$Sc=Pcf-Pcr$$

$$Sm=Pmf-Pmr$$

$$Sy=Pyf-Pyr$$

Then, the corrective value of the skew of each of the colors is defined respectively from the above amount of the skew and the timing of light emission in the sub scanning direction of the exposure unit such as the line head (LED, OPH) of each of the colors other than the reference color is modified on a chip by chip basis or a dot by dot basis to correct the skew.

While the present invention is described by way of various embodiments above, any of those embodiments may be appropriately combined within the scope of the present invention.

What is claimed is:

1. An image forming apparatus comprising:

a first image carrier that carries an image;

a first charging section that electrically charges the first image carrier;

a first exposure section that forms a latent image on the first image carrier electrically charged by the first charging section;

a first development section that develops the latent image formed by the first exposure section on the first image carrier by means of a first liquid developer;

a first primary transfer section that transfers a first image developed by the first development section onto a transfer belt;

a second image carrier that carries an image;

a second charging section that electrically charges the second image carrier;

a second exposure section that forms a latent image on the second image carrier electrically charged by the second charging section;

a second development section that develops the latent image formed by the second exposure section on the second image carrier by means of a second color liquid developer;

a second primary transfer section that transfers a second image developed by the second development section onto the transfer belt;

the transfer belt which is wound around a driving roller and tension roller;

a secondary transfer section that transfers the first image and the second image transferred onto the transfer belt further onto a recording medium;

a media type memory section that stores a type of recording medium to be transferred by the secondary transfer section;

a variable transfer pressure application mechanism that applies transfer pressure of a first level or of a second level at the secondary transfer section;

a variable transfer pressure application section control section that controls the variable transfer pressure application mechanism to apply transfer pressure of the first level or of the second level according to the type of recording medium stored in the media type memory section; and a controller that corrects an amount of color shift when the transfer pressure at the secondary transfer section changes from the transfer pressure of the first level to the transfer pressure of the second level according to the type of recording medium stored in the media type memory section by the variable transfer pressure application section control section.

2. The apparatus according to claim 1, further comprising:

an optical sensor that detects the first image and the second image transferred onto the transfer belt;

the controller having a computing section and a timing modification section;

the computing section for calculating the distance between the first image and the second image according to the detection by the optical sensor; and the timing modification control section that modifies a timing of light emission of the first exposure section and/or the second exposure section according to the distance calculated by the computing section.

3. The apparatus according to claim 2, further comprising:

a recording medium information input section that inputs the type of recording medium;

the timing modification control section being driven to operate in response to the input of information on the recording medium to the recording medium information input section.

4. The apparatus according to claim 3, further comprising:

a data input section that inputs image data:

the timing modification control section being driven to operate in response to the input of the image data to the data input section.

5. A method of controlling an image forming apparatus, the method comprising:

electrically charging a first image carrier;

exposing the first image carrier electrically charged;

developing the latent image formed on the first image carrier by means of a first color liquid developer;

transferring the first image developed onto a transfer belt;

electrically charging a second image carrier;

exposing the second image carrier electrically charged;

developing the latent image formed on the second image carrier by means of a second color liquid developer;

transferring the second image developed onto the transfer belt; and transferring the first image and the second image transferred onto the transfer belt further onto a recording medium of a first paper type, applying transfer pressure of a first level;

changing from a first recording medium to a second recording medium of a second paper type different from the first paper type;

correcting an amount of color shift;

electrically charging the first image carrier;

exposing the first image carrier electrically charged;

developing the latent image formed on the first image carrier by means of the first color liquid developer;

transferring the first image developed onto the transfer belt;

electrically charging the second image carrier;

exposing the second image carrier electrically charged;

developing the latent image formed on the second image carrier by means of the second color liquid developer;

transferring the second image developed onto the transfer belt; and transferring the first image and the second image transferred onto the transfer belt further onto the second recording medium, and applying transfer pressure of a second level.

6. The method according to claim 5, further comprising:

correcting an amount of color shift; wherein applying the transfer pressure of the second level;

transferring the first image and the second image onto the transfer belt;

detecting the first image and the second image transferred onto the transfer belt;

calculating a distance between the first image and the second image according to the detection; and modifying a timing of light emission of exposing the first image carrier according to the distance calculated.

7. The method according to claim 6, further comprising:

modifying a timing of light emission of exposing the second image carrier according to the distance calculated.

* * * * *